US010496003B2

(12) United States Patent
No et al.

(10) Patent No.: US 10,496,003 B2
(45) Date of Patent: Dec. 3, 2019

(54) EXPOSURE DEVICE

(71) Applicant: FUJI XEROX CO., LTD., Tokyo (JP)

(72) Inventors: Hiroshi No, Kanagawa (JP); Shuichi Nishide, Kanagawa (JP); Seiichi Takayama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/056,557

(22) Filed: Aug. 7, 2018

(65) Prior Publication Data

US 2019/0072873 A1 Mar. 7, 2019

(30) Foreign Application Priority Data

Sep. 4, 2017 (JP) ..... 2017-169627
Sep. 15, 2017 (JP) ..... 2017-178371
Mar. 14, 2018 (JP) ..... 2018-047280

(51) Int. Cl.
*G03G 15/04* (2006.01)
*G03G 15/01* (2006.01)

(52) U.S. Cl.
CPC ... *G03G 15/04054* (2013.01); *G03G 15/0105* (2013.01); *G03G 2215/0154* (2013.01)

(58) Field of Classification Search
CPC ..... G03G 15/04054; G03G 15/011; G03G 15/04036; G03G 2215/0154
See application file for complete search history.

(56) References Cited

U.S. PATENT DOCUMENTS 5,877,884 A * 3/1999 Yanagisawa ..... G02B 26/121 359/198.1
2016/0347083 A1* 12/2016 Ishidate ..... B41J 2/471
2017/0205730 A1* 7/2017 Kaneto ..... G03G 15/04054

FOREIGN PATENT DOCUMENTS

JP 2003075760 3/2003
JP 2009014984 1/2009

* cited by examiner

*Primary Examiner* — Sandra Brase
(74) *Attorney, Agent, or Firm* — JCIPRNET

(57) ABSTRACT

An exposure device includes an exposure section, a weight, and an elastic portion. The exposure section includes plural light emitting elements arranged along an axial direction of an image holding member that is rotatable, is positioned with respect to the image holding member at both ends in the axial direction, and exposes the image holding member to light by emitting light to the image holding member. The weight is disposed so as to face the exposure section, and has a mass determined in advance. The elastic portion is elastic, and is disposed between the exposure section and the weight to support the weight so as to be vibratable.

19 Claims, 20 Drawing Sheets

EXPOSURE DEVICE

CROSS-REFERENCE TO RELATED APPLICATIONS

This application is based on and claims priority under 35 USC 119 from Japanese Patent Application No. 2017-169627 filed Sep. 4, 2017, Japanese Patent Application No. 2017-178371 filed Sep. 15, 2017, and Japanese Patent Application No. 2018-047280 filed Mar. 14, 2018.

BACKGROUND

(i) Technical Field

The present invention relates to an exposure device.

(ii) Related Art

An exposure section includes light emitting diode (LED) print heads (LPHs) in which plural LEDs are arranged side by side along the rotational axis direction of a photosensitive drum and positioned at both end portions in the rotational axis direction with respect to the photosensitive drum, for example. When vibration caused outside the exposure section is input to the exposure section, vibration is caused in the sub scanning direction or the focus direction to cause banding. In particular, in the case where the exposure section resonates with vibration caused outside the exposure section, the exposure section tends to vibration greatly to cause banding.

SUMMARY

According to an aspect of the present invention, there is provided an exposure device including: an exposure section that includes plural light emitting elements arranged along an axial direction of an image holding member that is rotatable, that is positioned with respect to the image holding member at both ends in the axial direction, and that exposes the image holding member to light by emitting light to the image holding member; a weight disposed so as to face the exposure section and having a mass determined in advance; and an elastic portion that is elastic and that is disposed between the exposure section and the weight to support the weight so as to be vibratable.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
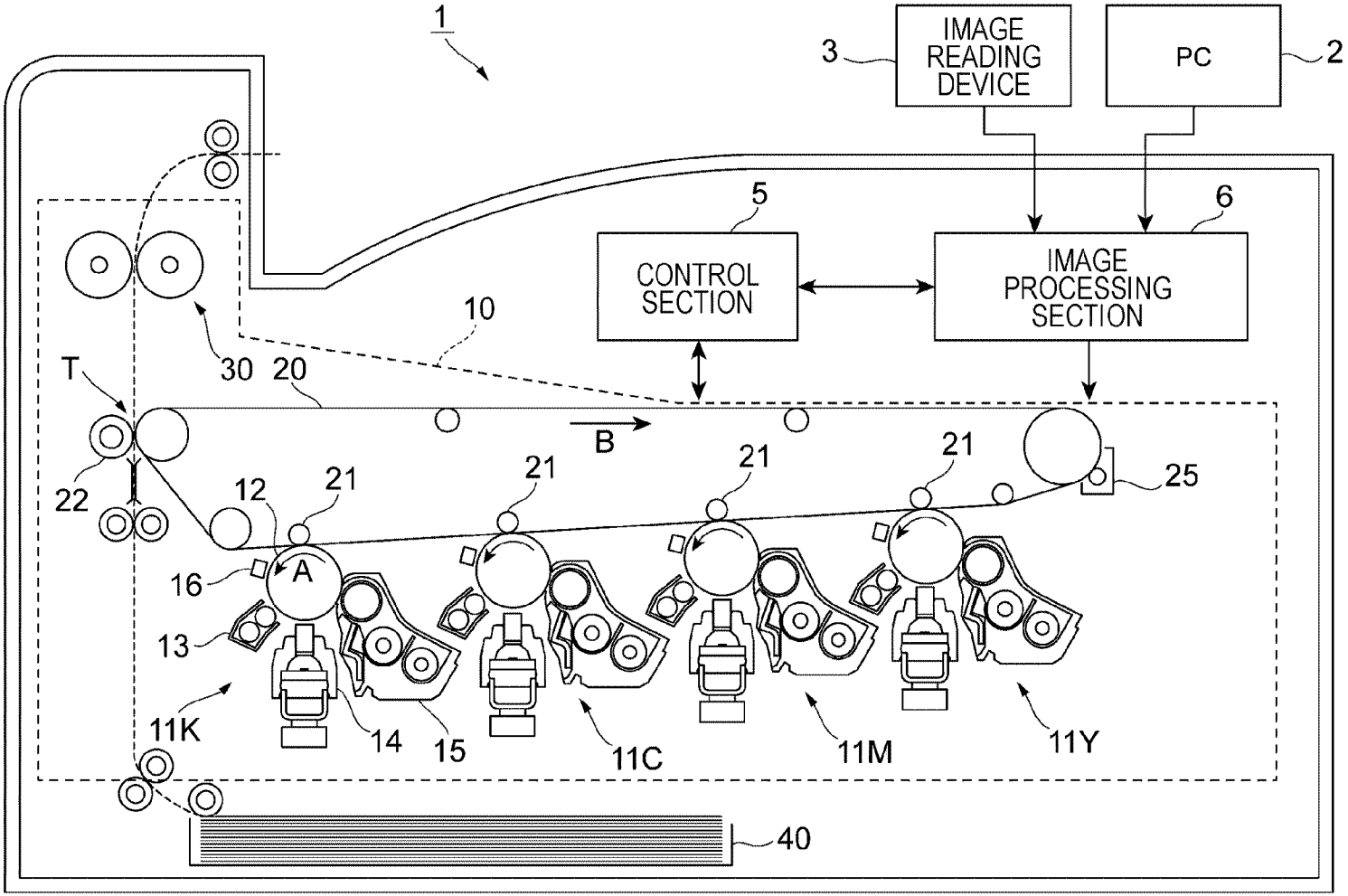
FIG. 1 illustrates the overall configuration of an image forming apparatus according to a first exemplary embodiment.

An exemplary embodiment of the present invention will be described in detail below with reference to the accompanying drawings. FIG. 1 illustrates the overall configuration of an image forming apparatus 1 according to a first exemplary embodiment.

The image forming apparatus 1 is an image forming apparatus generally called a tandem type. The image forming apparatus 1 includes an image forming section 10 that forms an image in correspondence with image data for various colors, a control section 5 that serves as an example of a control unit that controls operation of the entire image forming apparatus 1, and a paper holding section 40 that holds paper to be supplied to the image forming apparatus 1. The image forming apparatus 1 also includes an image processing section 6 that performs image processing determined in advance on image data received from a personal computer (PC) 2, an image reading device 3, etc., for example.

The image forming section 10 includes four image forming units 11Y, 11M, 11C, and 11K (also referred to collectively as "image forming units 11") disposed in parallel at constant intervals. The image forming units 11 each include a photosensitive drum 12 that serves as an example of an image holding member that holds a toner image by forming an electrostatic latent image, a charging unit 13 that charges a surface of the photosensitive drum 12 at a potential determined in advance, an exposure device 14 that exposes the photosensitive drum 12 charged by the charging unit 13 to light on the basis of image data for various colors, a developer 15 that develops the electrostatic latent image formed on the photosensitive drum 12, and a drum cleaner 16 that cleans the surface of the photosensitive drum 12 after transfer.

The image forming units 11 are configured similarly to each other except for toner housed in the developer 15, and form yellow (Y), magenta (M), cyan (C), and black (K) toner images, respectively.

The image forming section 10 also includes an intermediate transfer belt 20 to which toner images in various colors formed by the photosensitive drums 12 of the image forming units 11 are transferred in a multiplexed manner, and first transfer rollers 21 that sequentially transfer (first transfer) the toner images in various colors formed by the image forming units 11 onto the intermediate transfer belt 20. The image forming section 10 further includes a second transfer roller 22 that collectively transfers (second transfer) the toner images in various colors, which have been transferred onto the intermediate transfer belt 20 as superposed on each other, to paper that serves as a recording material (recording paper), a belt cleaner 25 that cleans a surface of the intermediate transfer belt 20 after the second transfer, and a fixing device 30 that fixes the toner images in various colors, which have been subjected to the second transfer, onto paper P.

In the image forming apparatus 1, the image forming section 10 performs image forming operation on the basis of various kinds of control signals supplied from the control section 5. That is, under control by the control section 5, image data input from a personal computer (PC) 2 or an image reading device 3 are subjected to image processing performed by the image processing section 6, and supplied to the image forming units 11. Then, in each of the image forming units 11, the photosensitive drum 12 is charged by the charging unit 13 and exposed to light by the exposure device 14, and an electrostatic latent image is developed by the developer 15 to form toner images in various colors on the surface of the photosensitive drum 12.

Then, the toner images in various colors formed on the photosensitive drum 12 are sequentially transferred onto the intermediate transfer belt 20 by the first transfer roller 21.

Then, a synthesized toner image on the intermediate transfer belt 20 is transported to a region (second transfer portion T), in which the second transfer roller 22 is disposed, along with movement of the intermediate transfer belt 20. When the synthesized toner image is transported to the second transfer portion T, paper is supplied from the paper holding section 40 to the second transfer portion T at the same timing as the synthesized toner image is transported to the second transfer portion T. Then, the synthesized toner image is collectively electrostatically transferred onto the paper, which has been transported, by a transfer electric field formed by the second transfer roller 22 at the second transfer portion T.

After that, the paper to which the synthesized toner image has been transferred is transported to the fixing device 30, and subjected to a fixing process using heat and a pressure so that the toner image is fixed onto the paper. Then, the paper to which the toner image has been fixed is transported to a paper loading portion provided at an ejection portion of the image forming apparatus 1.

Meanwhile, toner adhering to the intermediate transfer belt 20 after the second transfer is removed from the surface of the intermediate transfer belt 20 by the belt cleaner 25 after the second transfer is finished. In this way, image formation in the image forming apparatus 1 is repeatedly executed in cycles for a number of sheets to be printed.

Subsequently, the configuration of the exposure device 14 according to the present exemplary embodiment will be described.

Figure 2A:
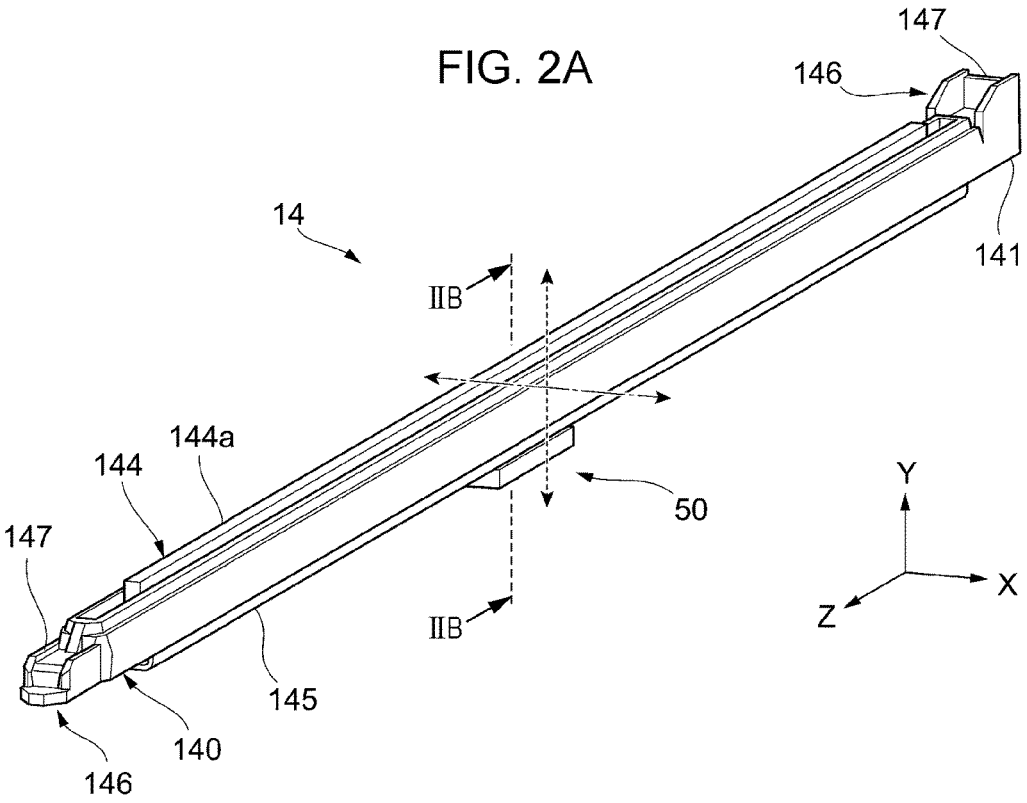
FIGS. 2A and 2B illustrate an exposure device according to the first exemplary embodiment.
Figure 2B:
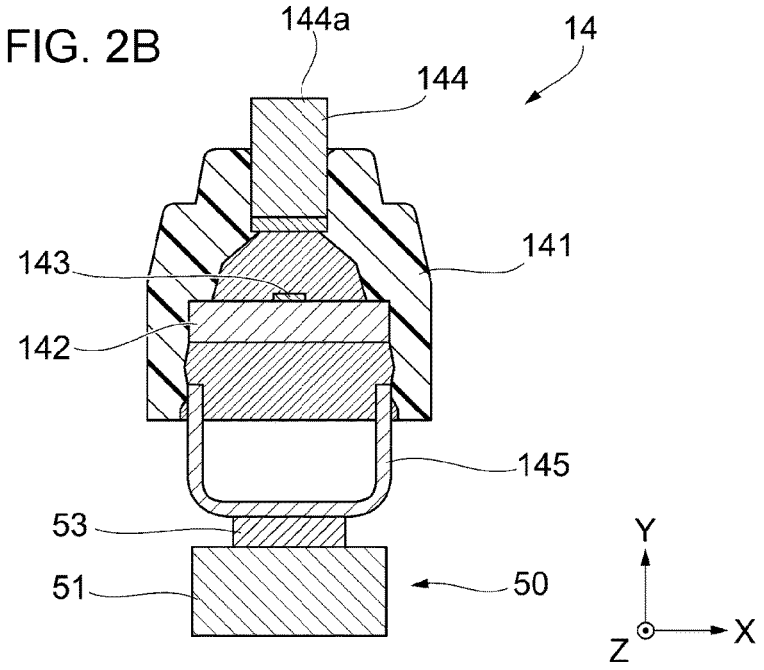

FIGS. 2A and 2B illustrate the exposure device 14 according to the first exemplary embodiment. FIG. 2A is a perspective view of the exposure device 14. FIG. 2B is a cross-sectional view taken along the line IIB-IIB in FIG. 2A.

The exposure device 14 is disposed vertically below the photosensitive drum 12 in the image forming apparatus 1 illustrated in FIG. 1, and exposes the photosensitive drum 12 to light from vertically below. As illustrated in FIGS. 2A and 2B, the exposure device 14 includes a light emitting diode (LED) print head (LPH) 140 that serves as an example of an exposure section, and a dynamic vibration absorber 50 that reduces vibration of the LPH 140.

The LPH 140 includes a housing 141, an LED array 143 that includes plural light emitting elements, an LED circuit substrate 142 on which the LED array 143, a signal generation circuit (not illustrated) that drives the LED array 143, etc. are mounted, a rod lens array 144 that forms an image on the surface of the photosensitive drum 12 using light emitted from the LED array 143, and a frame 145 which reinforces the housing 141 and to which the dynamic vibration absorber 50 to be discussed later is attached. The LPH 140 also includes first positioning portions 146 and second positioning portions 147 at both end portions in the axial direction of the photosensitive drum 12. The first positioning portions 146 position the LPH 140 in the X direction with respect to the photosensitive drum 12. The second positioning portions 147 position the LPH 140 in the Y direction with respect to the photosensitive drum 12.

In the following description, the optical axis direction of the rod lens array 144 in the LPH 140 illustrated in FIGS. 2A and 2B (the direction of emission of light by the light emitting elements of the LED array 143) is occasionally referred to as the Y direction. Meanwhile, the principal scanning direction, that is, the axial direction of the photosensitive drum 12 (see FIG. 1), is occasionally referred to as the Z direction. Further, the sub scanning direction, that is, a direction that is orthogonal to both the Y direction and the Z direction, is occasionally referred to as the X direction.

The housing 141 is formed from a resin material such as ABS, for example, and supports the LED circuit substrate 142 and the rod lens array 144.

The frame 145 is formed from a metal material such as steel or SUS, for example, and attached to the opposite side of the rod lens array 144 with respect to the housing 141. A support portion 53, to be discussed later, of the dynamic vibration absorber 50 is attached to the frame 145.

The rod lens array 144 is disposed along the axial direction (Z direction) of the photosensitive drum 12, and formed to have a width in the moving direction (X direction) of the photosensitive drum 12. The rod lens array 144 is formed by arranging plural gradient index lenses that form an erect real image with unity magnification in the axial direction of the photosensitive drum 12, for example. The rod lens array 144 forms an image on the surface of the photosensitive drum 12 using light emitted from the LED array 143.

The LED array 143 is mounted on the LED circuit substrate 142. The LED array 143 is formed from plural LED chips each including a light emitting element (LED) and arranged side by side in the Z direction. Consequently, the plural light emitting elements are disposed side by side in the Z direction on the LED circuit substrate 142. The light emitting elements are disposed so as to emit light in the Y direction toward the photosensitive drum 12 (rod lens array 144). In the LED array 143 according to the present exemplary embodiment, the LED chips are disposed in a staggered manner such that the light emitting elements are superposed on each other in position in the Z direction at the boundary between adjacent LED chips.

The first positioning portions 146 and the second positioning portions 147 are provided at both ends of the housing 141 in the Z direction. The first positioning portions 146 are formed from a wall surface that extends in the Y direction and the Z direction at both ends of the housing 141. Meanwhile, the second positioning portions 147 are formed from an end portion, positioned downstream in the Y direction, of a wall surface that extends in the Y direction and the Z direction at both ends of the housing 141.

The first positioning portions 146 and the second positioning portions 147 are caused to abut against a housing member (not illustrated) that houses and supports the photosensitive drum 12 in the image forming apparatus 1 in the case where the exposure device 14 is installed in the image forming apparatus 1. More specifically, the first positioning portions 146 are caused to abut against the housing member for the photosensitive drum 12 in the X direction, and the second positioning portions 147 are caused to abut against the housing member for the photosensitive drum 12 in the Y direction.

Consequently, the LPH 140 is positioned in both the X direction and the Y direction with respect to the photosensitive drum 12 at both ends in the Z direction. The LPH 140 is disposed at a position at which the distance between the rod lens array 144 of the LPH 140 and the photosensitive drum 12 matches the focal length of the rod lens array 144.

In the present exemplary embodiment, the middle portion of the LPH 140 in the Z direction, that is, a region of the LPH 140 interposed between the first positioning portions 146 and the second positioning portions 147 which are provided at both ends in the Z direction, is raised from the photosensitive drum 12, rather than contacting the photosensitive drum 12.

The LPH 140, which is shaped to be long in the Z direction and positioned with respect to the photosensitive drum 12 at both ends in the Z direction as in the present exemplary embodiment, is occasionally warped to cause vibration upon receiving vibration from the outside of the exposure device 14. Specifically, the middle portion of the LPH 140 in the Z direction occasionally vibrates in the Y direction as indicated by the broken arrow in FIG. 2A, and occasionally vibrates in the X direction as indicated by the dot-and-dash arrow in FIG. 2A.

For example, in the case where the LPH 140 vibrates in the Y direction, the distance between the rod lens array 144 and the surface of the photosensitive drum 12 is fluctuated. Therefore, the size of an exposure point due to light emitted from the LPH 140 is fluctuated. In the case where the LPH 140 vibrates in the X direction, meanwhile, the exposure point is shifted in the X direction to bend an image. As a result, an image defect such as streaking or color irregularity may be caused in an image to be formed. In particular, an image tends to be affected greatly in the case where the LPH 140 vibrates in the X direction.

In the case where the frequency of vibration input to the LPH 140 from the outside is close to the natural frequency of the LPH 140, the LPH 140 tends to resonate with the vibration from the outside. In this case, the LPH 140 tends to vibrate greatly to cause an image defect.

As discussed above, the LPH 140 according to the present exemplary embodiment is positioned with respect to the photosensitive drum 12 at both end portions in the Z direction, and the middle portion of the LPH 140 in the Z direction is raised from the photosensitive drum 12. Therefore the LPH 140 tends to vibrate more greatly at a location closer to the middle portion in the Z direction.

In the exposure device 14, in contrast, the dynamic vibration absorber 50 is attached to the LPH 140 to reduce vibration of the LPH 140 using the dynamic vibration absorber 50. The dynamic vibration absorber 50 according to the first exemplary embodiment preferentially reduces vibration of the LPH 140 in the X direction, which affects an image more greatly.

Figure 3:
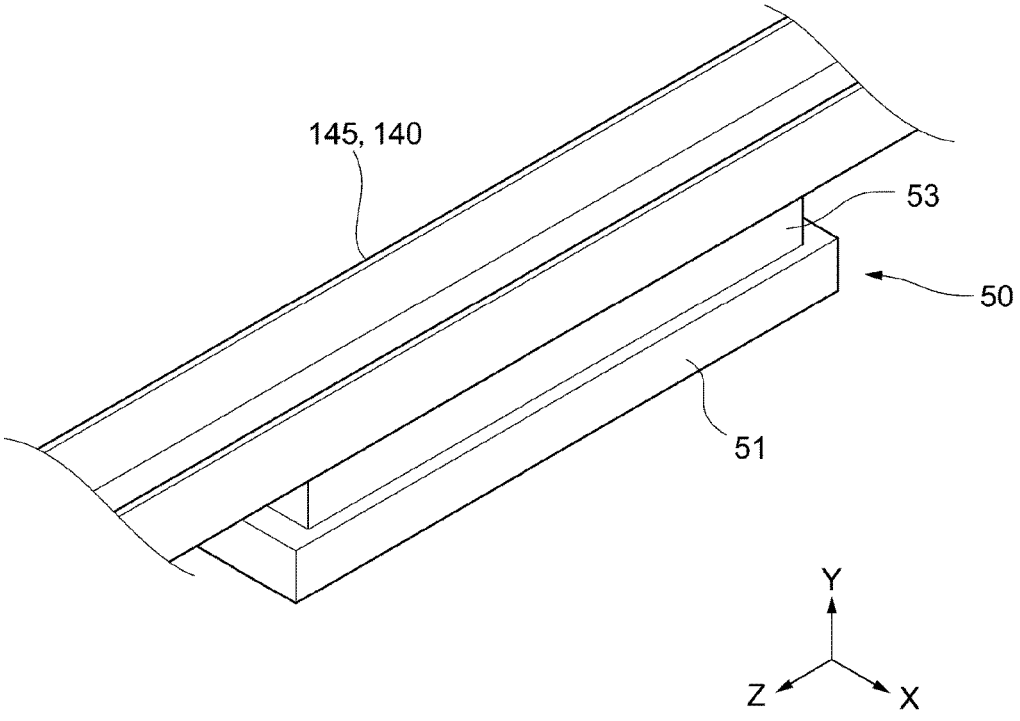
FIG. 3 illustrates the configuration of a dynamic vibration absorber according to the first exemplary embodiment, illustrating a middle portion in the Z direction in FIG. 2A as enlarged.

FIG. 3 illustrates the configuration of the dynamic vibration absorber 50 according to the first exemplary embodiment, illustrating the middle portion in the Z direction in FIG. 2A as enlarged. In FIG. 3, the components of the LPH 140 other than the frame 145 are not illustrated. Subsequently, the configuration of the dynamic vibration absorber 50 will be described in detail with reference to FIGS. 3, 2B, etc.

The dynamic vibration absorber 50 is attached to the middle portion of the frame 145 of the LPH 140 in the Z direction. The dynamic vibration absorber 50 does not contact the members other than the frame 145, and is raised from the other members.

As discussed above, the LPH 140 tends to vibrate more greatly at a location closer to the middle portion in the Z direction. Therefore, vibration of the LPH 140 is easily suppressed by providing the dynamic vibration absorber 50 in proximity to the middle portion of the frame 145 in the Z direction. In other words, the dynamic vibration absorber 50 is preferably attached to a position of the LPH 140 at which the amplitude of vibration is the greatest. A position in proximity to the middle portion in the Z direction refers to a range of one-third of the overall length in the Z direction at the middle portion in the Z direction, for example.

The dynamic vibration absorber 50 includes a weight 51 disposed so as to face the LPH 140 and having a mass determined in advance, and the support portion 53 which is attached to the frame 145 of the LPH 140 to support the weight 51.

In the dynamic vibration absorber 50, as illustrated in FIG. 2B, the support portion 53 and the weight 51 are disposed side by side in the opposite direction (toward the upstream side in the Y direction) to the direction of emission of light by the LPH 140 (LED array 143).

In the case where the mass of the weight 51 is defined as M and the spring constant of the support portion 53 is defined as K, the dynamic vibration absorber 50 has a natural frequency f represented by the following formula (1).

[Expression 1]

$$f = \frac{1}{2\pi}\sqrt{\frac{K}{M}} \quad (1)$$

The mass M of the weight 51 and the spring constant K of the support portion 53 are preferably set such that the natural frequency f of the dynamic vibration absorber 50, which is represented by the above formula (1), is generally equal to the natural frequency (hereinafter, fa) of the LPH 140. With the natural frequency f of the dynamic vibration absorber 50 and the natural frequency fa of the LPH 140 generally equal to each other, the dynamic vibration absorber 50 (weight 51) vibrates in place of the LPH 140 to suppress resonance of the LPH 140 due to vibration from the outside of the exposure device 14. In the dynamic vibration absorber 50 according to the first exemplary embodiment, the weight 51 and the support portion 53 are set such that the natural frequency f of the dynamic vibration absorber 50 for vibration in the X direction is generally equal to the natural frequency fa of the LPH 140 for vibration in the X direction. The phrase "generally equal natural frequencies" means that the difference between the peaks of the natural frequency f of the dynamic vibration absorber 50 and the natural frequency fa of the LPH 140 is equal to or less than 10 Hz, for example.

The weight 51 is a member that vibrates via the support portion 53 in the case where vibration is input to the LPH 140 from the outside.

The material forming the weight 51 is not specifically limited. However, a material that provides the weight 51 with the mass M that makes the natural frequency f of the dynamic vibration absorber 50 generally equal to the natural frequency fa of the LPH 140 on the basis of the above formula (1) is selected. Examples of the material forming the weight 51 include a material that is higher in density than the material forming the support portion 53 to be discussed later, for example. Specific examples of the material forming the weight 51 include a metal material such as steel or SUS and a resin material.

As illustrated in FIGS. 2B and 3, the weight 51 has a rectangular parallelepiped shape having surfaces that are parallel to the XY plane, the YZ plane, and the ZX plane. More specifically, the weight 51 has a rectangular parallelepiped shape which is long in the Z direction and in which the thickness in the Y direction is smaller than the width in the X direction in a cross section that is perpendicular to the Z direction. A surface of the weight 51 positioned on the downstream side in the Y direction is attached to the support portion 53.

The shape of the weight 51 is not specifically limited. From the viewpoint of suppressing fluctuations in vibration of the weight 51 in the X direction and the Y direction, however, the weight 51 is preferably shaped so as to be symmetrical with respect to a plane (XY plane) that extends in the X direction and the Y direction, a plane (YZ plane) that extends in the Y direction and the Z direction, and a plane (ZX plane) that extends in the Z direction and the X direction.

From the viewpoint of reducing the size of the exposure device 14, the width of the weight 51 in the X direction is preferably equal to or less than the width of the LPH 140 in the X direction.

The support portion 53 is an example of the elastic portion, and is a viscoelastic member that is viscous and elastic and that supports the weight 51 with respect to the LPH 140 so as to be vibratable. The support portion 53 is disposed between the LPH 140 (frame 145) and the weight 51. The support portion 53 being disposed between the LPH 140 and the weight 51 corresponds to a state in which the weight 51 is connected to the LPH 140 via the support portion 53. In this case, a different member may be interposed between the weight 51 and the support portion 53 or between the LPH 140 and the support portion 53.

The material forming the support portion 53 is not specifically limited. However, a material that provides the support portion 53 with the spring constant K that makes the natural frequency f of the dynamic vibration absorber 50 generally equal to the natural frequency fa of the LPH 140 on the basis of the above formula (1) is selected. Specific examples of the material forming the support portion 53 include a porous material such as sponge, a rubber material, and a resin material.

As illustrated in FIGS. 2B and 3, the support portion 53 has a rectangular parallelepiped shape having surfaces that are parallel to the XY plane, the YZ plane, and the ZX plane. More specifically, as with the weight 51, the support portion 53 has a rectangular parallelepiped shape which is long in the Z direction and in which the thickness in the Y direction is smaller than the width in the X direction in a cross section that is perpendicular to the Z direction. In this example, the volume of the support portion 53 is smaller than the volume of the weight 51.

As with the weight 51, the support portion 53 is preferably shaped so as to be symmetrical with respect to the XY plane, the YZ plane, and the ZX plane.

A surface of the support portion 53 on the downstream side in the Y direction is attached to the frame 145 of the LPH 140. A surface of the support portion 53 on the upstream side in the Y direction supports the weight 51.

The method of connection between the support portion 53 and the weight 51 is not specifically limited. Examples of the connection method include pasting using an adhesive, an adhesive tape, or the like. Alternatively, the support portion 53 and the weight 51 may be connected to each other by providing a groove or the like in the weight 51 and fitting the support portion 53 with the groove or the like, for example.

In the dynamic vibration absorber 50 according to the present exemplary embodiment, as discussed above, the support portion 53 and the weight 51 are provided side by side in the Y direction. Consequently, the support portion 53 is subjected to compression deformation in the case where the weight 51 vibrates in the Y direction. Meanwhile, the support portion 53 is subjected to shear deformation in the case where the weight 51 vibrates in the X direction. The support portion 53 according to the present exemplary embodiment is shaped such that the thickness in the Y direction is smaller than the width in the X direction.

Furthermore, the spring constant K of the support portion 53 for a case where the support portion 53 is subjected to shear deformation in the X direction is smaller than the spring constant K thereof for a case where the support portion 53 is subjected to compression deformation in the Y direction.

Consequently, in the first exemplary embodiment, the natural frequency f of the dynamic vibration absorber 50 for vibration in the X direction and the natural frequency f thereof for vibration in the Y direction differ from each other. Normally, the natural frequency fa of the LPH 140 for vibration in the X direction and the natural frequency fa thereof for vibration in the Y direction are close to each other, although depending on the structure of the LPH 140.

Therefore, in the first exemplary embodiment, it is difficult to make an adjustment such that the natural frequency f of the dynamic vibration absorber 50 and the natural frequency fa of the LPH 140 are generally equal to each other for both vibration in the X direction and vibration in the Y direction.

Thus, in the first exemplary embodiment, an adjustment is preferably made such that the natural frequency f of the dynamic vibration absorber 50 and the natural frequency fa of the LPH 140 are generally equal to each other for vibration in the X direction in which vibration of the LPH 140 tends to affect the image quality. Additionally, the mass M of the weight 51 and the spring constant K of the support portion 53 are preferably adjusted such that the natural frequency f of the dynamic vibration absorber 50 and the natural frequency fa of the LPH 140 are generally equal to each other for vibration in the X direction.

Subsequently, the function of the dynamic vibration absorber 50 will be described. When vibration is input to the exposure device 14 from the outside, the weight 51 of the dynamic vibration absorber 50 vibrates in place of the LPH 140. Vibration of the weight 51 repeatedly deforms the support portion 53. As a result, the viscosity of the support portion 53 acts to damp vibration.

In the first exemplary embodiment, as discussed above, an adjustment is made such that the natural frequency f of the dynamic vibration absorber 50 and the natural frequency fa of the LPH 140 are generally equal to each other for vibration in the X direction. Therefore, vibration of the LPH 140 in the X direction is principally absorbed and damped by the dynamic vibration absorber 50 through vibration of the weight 51 and deformation of the support portion 53.

As discussed above, the dynamic vibration absorber 50 according to the first exemplary embodiment is attached to the frame 145 of the LPH 140, and is raised from the members other than the frame 145, rather than contacting such members. Consequently, application of a load to the LPH 140 is suppressed compared to a case where an elastic member or the like is pressed against the LPH 140 in order to suppress vibration of the LPH 140, for example.

Second Exemplary Embodiment

Subsequently, a second exemplary embodiment of the present invention will be described. In the description of the second exemplary embodiment, components that are similar to those of the first exemplary embodiment are denoted by the same reference numerals to omit detailed description thereof.

Figure 4A:
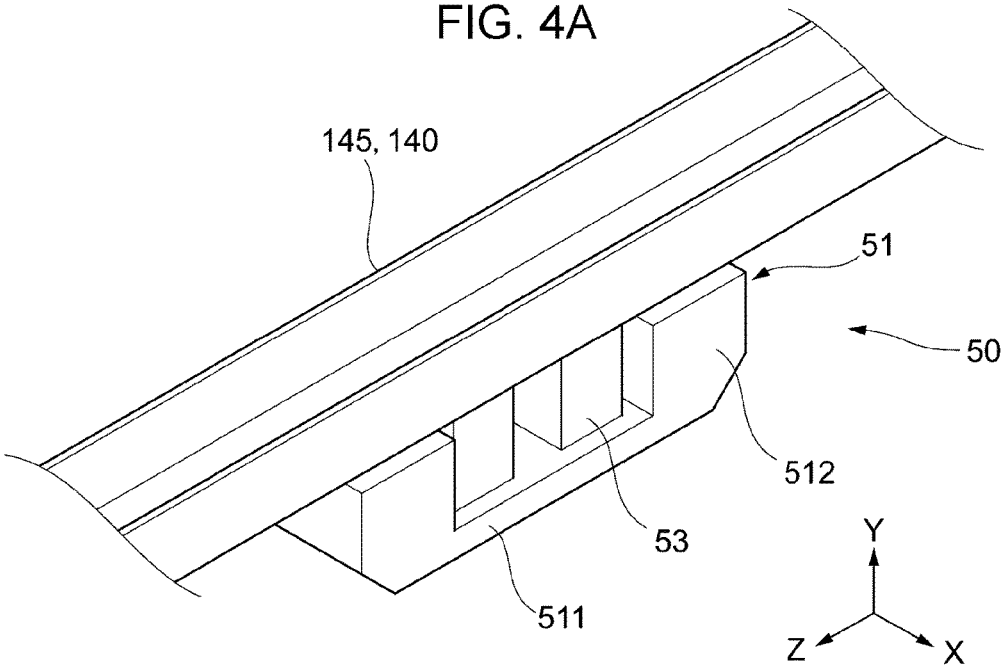
FIGS. 4A and 4B illustrate the configuration of a dynamic vibration absorber according to a second exemplary embodiment.
Figure 4B:
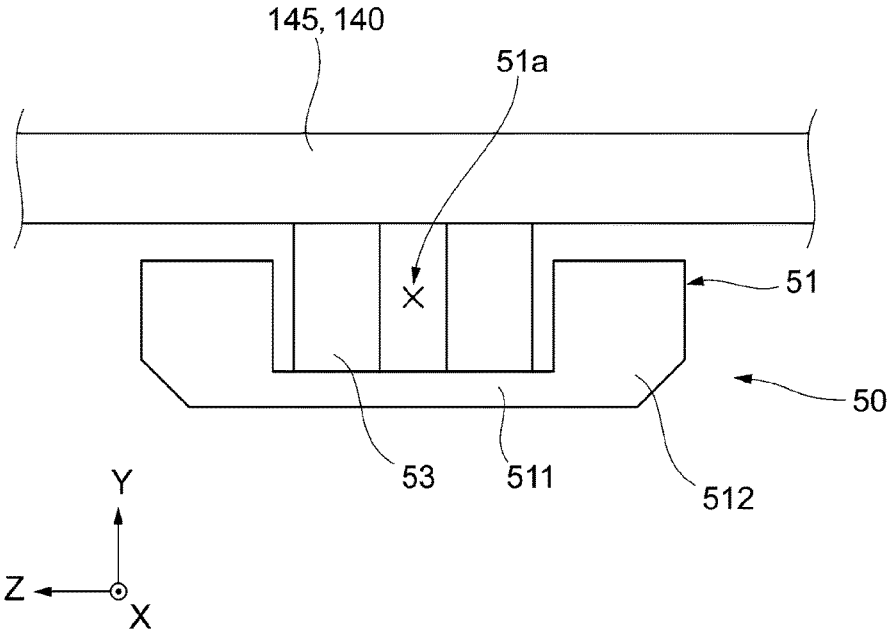

FIGS. 4A and 4B illustrate the configuration of the dynamic vibration absorber 50 according to the second exemplary embodiment. FIG. 4A is an enlarged view of the middle portion of the exposure device 14 (see FIG. 1) in the Z direction. FIG. 4B is a view in which FIG. 4A is seen from the downstream side in the X direction. In FIGS. 4A and 4B, the components of the LPH 140 other than the frame 145 are not illustrated.

In the second exemplary embodiment, as illustrated in FIGS. 4A and 4B, two support portions 53 are provided at the middle portion of the frame 145 of the LPH 140 in the Z direction. Additionally, the two support portions 53 are provided side by side via a gap in the Z direction at the middle portion of the frame 145 in the Z direction.

The support portions 53 have the same rectangular parallelepiped shape as each other. Specifically, as illustrated in FIG. 4B, the support portions 53 have a rectangular parallelepiped shape in which the thickness in the Y direction is larger than the length in the Z direction in the case where the support portions 53 are seen in the X direction. Although not illustrated, the support portions 53 have a thickness in the Y direction that is larger than the width in the X direction.

Respective surfaces of the support portions 53 on the downstream side in the Y direction are attached to the frame 145 of the LPH 140. Respective surfaces of the support portions 53 on the upstream side in the Y direction support the weight 51.

As illustrated in FIGS. 4A and 4B, the weight 51 according to the second exemplary embodiment includes a connection portion 511 which is positioned at the middle portion in the Z direction and to which the support portions 53 are connected, and thick-walled portions 512 that are provided at both ends of the connection portion 511 in the Z direction and that are thicker in the Y direction than the connection portion 511. The thick-walled portions 512 extend from both ends of the connection portion 511 in the Z direction toward the downstream side in the Y direction (toward the frame 145 of the LPH 140).

Consequently, in the second exemplary embodiment, the position (indicated by symbol 51*a* in FIG. 4B) of the center of gravity of the weight 51 in the Y direction is located closer to the LPH 140 than the position of connection between the weight 51 (connection portion 511) and the support portions 53. In this example, the center of gravity 51*a* of the weight 51 is positioned between the thick-walled portions 512 of the weight 51.

In the first exemplary embodiment discussed above, the support portion 53 has a rectangular parallelepiped shape in which the thickness in the Y direction is smaller than the width in the X direction. The support portion 53 is subjected to compression deformation in the Y direction, and to shear deformation in the X direction. Consequently, in the dynamic vibration absorber 50 according to the first exemplary embodiment, the spring constant K of the support portion 53 for deformation in the Y direction is smaller than the spring constant K thereof for deformation in the X direction. Therefore, it is difficult for the dynamic vibration absorber 50 according to the first exemplary embodiment to reduce both vibration of the LPH 140 in the Y direction and vibration thereof in the X direction.

In contrast, it is possible for the dynamic vibration absorber 50 according to the second exemplary embodiment, in which the weight 51 and the support portions 53 are shaped as discussed above, to reduce both vibration of the LPH 140 in the Y direction and vibration thereof in the X direction compared to the first exemplary embodiment.

That is, in the dynamic vibration absorber 50 according to the second exemplary embodiment, the support portions 53 are shaped to be thick in the Y direction compared to the first exemplary embodiment. Consequently, the spring constant K of the support portions 53 for deformation in the Y direction is reduced to be close to the spring constant K thereof for deformation in the X direction compared to the first exemplary embodiment. As a result, the natural frequency f of the dynamic vibration absorber 50 for vibration in the X direction and the natural frequency f thereof for vibration in the Y direction may be brought close to each other compared to the first exemplary embodiment. Then, the natural frequency f of the dynamic vibration absorber 50 may be brought close to the natural frequency fa of the LPH 140 for vibration in the Y direction compared to the first exemplary embodiment even in the case where an adjustment is made such that the natural frequency f of the dynamic vibration absorber 50 and the natural frequency fa of the LPH 140 are generally equal to each other for vibration in the X direction, for example.

In the dynamic vibration absorber 50 according to the second exemplary embodiment, the weight 51 vibrates when vibration is input to the exposure device 14 from the outside. Vibration of the weight 51 repeatedly deforms the support portions 53 so that vibration is damped by the viscosity of the support portions 53. Consequently, vibration of the LPH 140 in the X direction is suppressed, and vibration of the LPH 140 in the Y direction is suppressed.

In the case where the thickness of the support portion 53 in the Y direction is simply increased in order to reduce the spring constant K for deformation in the Y direction in the dynamic vibration absorber 50 according to the first exemplary embodiment illustrated in FIGS. 2A, 2B, and 3, for example, the center of gravity of the weight 51 is located away from the LPH 140. In this case, the properties of the dynamic vibration absorber 50 in suppressing vibration of the LPH 140 may be degraded. That is, the weight 51 vibrates at a position away from the LPH 140, and therefore the effect of the dynamic vibration absorber 50 in suppressing vibration of the LPH 140 may be reduced.

In the second exemplary embodiment, in contrast, the center of gravity of the weight 51 is located close to the LPH 140, compared to a case where the thickness of the support portion 53 in the Y direction is simply increased, by providing the weight 51 with the thick-walled portions 512 which extend toward the LPH 14. Consequently, degradation of the properties of the dynamic vibration absorber 50 in suppressing vibration of the LPH 140 is suppressed compared to a case where the weight 51 is not provided with the thick-walled portions 512, for example.

The dynamic vibration absorber 50 illustrated in FIGS. 4A and 4B is provided with two support portions 53 arranged side by side in the Z direction. However, a single support portion 53 or three or more support portions 53 may be provided. The support portions 53 may have a different shape, such as a circular column shape, for example, in which the thickness in the Y direction is larger than the width in the X direction.

Third Exemplary Embodiment

Subsequently, a third exemplary embodiment of the present invention will be described. In the description of the third exemplary embodiment, components that are similar to those of the first and second exemplary embodiments are denoted by the same reference numerals to omit detailed description thereof.

Figure 5A:
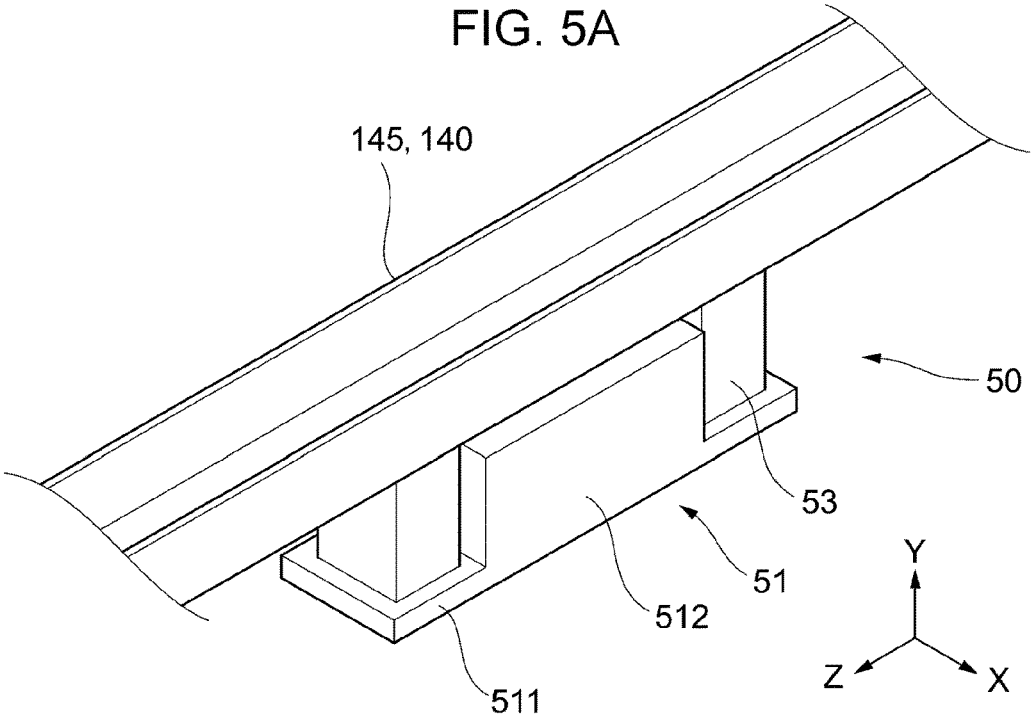
FIGS. 5A and 5B illustrate the configuration of a dynamic vibration absorber according to a third exemplary embodiment.
Figure 5B:
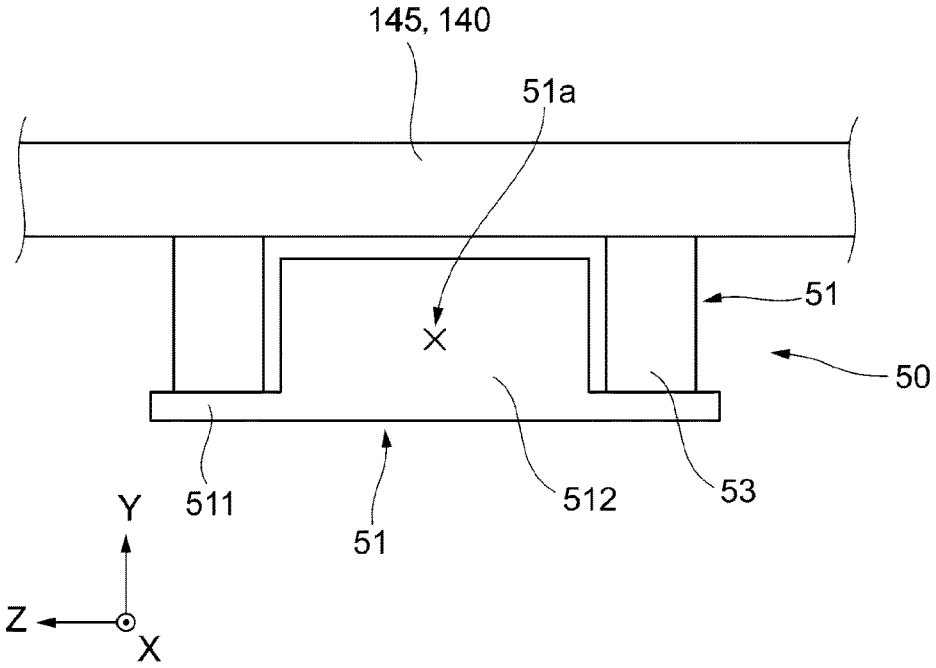

FIGS. 5A and 5B illustrate the configuration of the dynamic vibration absorber 50 according to the third exemplary embodiment. FIG. 5A is an enlarged view of the middle portion of the exposure device 14 (see FIG. 1) in the Z direction. FIG. 5B is a view in which FIG. 5A is seen from the downstream side in the X direction. In FIGS. 5A and 5B, the components of the LPH 140 other than the frame 145 are not illustrated.

In the dynamic vibration absorber 50 according to the second exemplary embodiment discussed above, the support portions 53 are disposed at the middle portion of the LPH 140 in the Z direction and between the two thick-walled portions 512 of the weight 51. Therefore, in the second exemplary embodiment, the weight 51 is occasionally subjected to rotational vibration about the support portions 53. More specifically, the weight 51 is occasionally subjected to rotational vibration about the support portions 53, which are positioned at the middle portion in the Z direction, with the Y direction serving as an axis. In the case where the weight 51 is subjected to rotational vibration, vibration of the LPH 140 may be increased because of the rotational vibration.

In the dynamic vibration absorber 50 according to the third exemplary embodiment, in contrast, rotational vibration of the weight 51 is suppressed compared to the second exemplary embodiment by changing the shape of the weight 51 and the support portions 53.

As illustrated in FIGS. 5A and 5B, the weight 51 according to the third exemplary embodiment is provided with the connection portions 511, to which the support portions 53 are connected, at both ends in the Z direction. The thick-walled portion 512, which is thicker in the Y direction than the connection portions 511, is provided at the middle portion in the Z direction and between the two connection portions 511. The thick-walled portion 512 projects toward the downstream side in the Y direction (toward the LPH 140) compared to the connection portions 511.

In the dynamic vibration absorber 50 according to the third exemplary embodiment, the support portions 53 are connected to the respective connection portions 511 which are positioned at both ends of the thick-walled portion 512.

The support portions 53 have the same rectangular parallelepiped shape as each other. Specifically, as in the second exemplary embodiment, the support portions 53 each have a rectangular parallelepiped shape. Specifically, the support portions 53 have a rectangular parallelepiped shape in which the thickness in the Y direction is larger than the width in the X direction and the length in the Z direction. Respective surfaces of the support portions 53 on the downstream side in the Y direction are attached to the frame 145 of the LPH 140. Respective surfaces of the support portions 53 on the upstream side in the Y direction support the weight 51.

In the dynamic vibration absorber 50 according to the third exemplary embodiment, as in the second exemplary embodiment, the position (indicated by symbol 51*a* in FIG. 5B) of the center of gravity of the weight 51 in the Y direction is located closer to the LPH 140 than the position of connection between the weight 51 (connection portions 511) and the support portions 53. In this example, the center of gravity 51*a* of the weight 51 is positioned in the thick-walled portion 512 of the weight 51.

Consequently, in the dynamic vibration absorber 50 according to the third exemplary embodiment, as with the second exemplary embodiment, degradation of the properties of the dynamic vibration absorber 50 in suppressing vibration of the LPH 140 is suppressed by suppressing separation of the center of gravity 51*a* of the weight 51 from the LPH 140.

In addition, in the dynamic vibration absorber 50 according to the third exemplary embodiment, as illustrated in FIGS. 5A and 5B, the spacing between the two support portions 53 in the Z direction is large compared to the second exemplary embodiment. The thick-walled portion 512 of the weight 51 is positioned between the two support portions 53.

Consequently, with the dynamic vibration absorber 50 according to the third exemplary embodiment, rotational vibration about the support portions 53 of the weight 51 with the Y direction serving as an axis is suppressed.

Further, in the dynamic vibration absorber 50 according to the third exemplary embodiment, as in the second exemplary embodiment, the support portions 53 are shaped to be thick in the Y direction compared to the first exemplary embodiment. In the dynamic vibration absorber 50 according to the third exemplary embodiment, the weight 51 vibrates when vibration is input to the exposure device 14 from the outside. Vibration of the weight 51 repeatedly deforms the support portions 53 so that vibration is damped by the viscosity of the support portions 53. Consequently, vibration of the LPH 140 in the X direction is suppressed, and vibration of the LPH 140 in the Y direction is suppressed.

Fourth Exemplary Embodiment

Subsequently, a fourth exemplary embodiment of the present invention will be described. In the description of the fourth exemplary embodiment, components that are similar to those of the first to third exemplary embodiments are denoted by the same reference numerals to omit detailed description thereof.

Figure 6C:
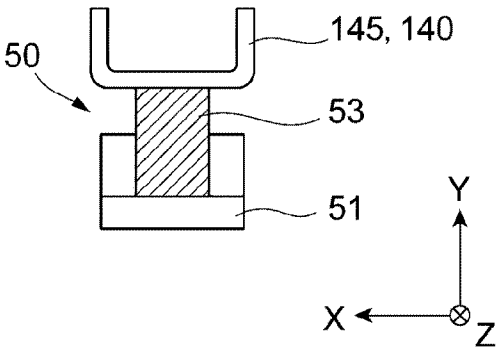
FIGS. 6A to 6C illustrate the configuration of a dynamic vibration absorber according to a fourth exemplary embodiment.
Figure 6A:
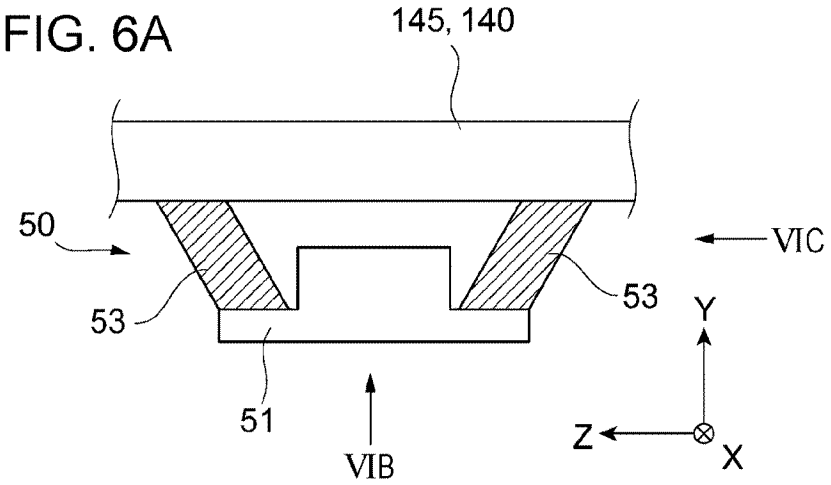
Figure 6B:
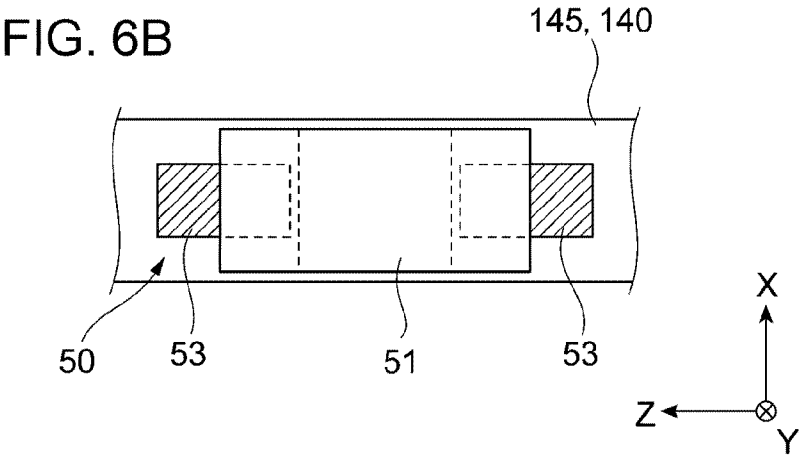

FIGS. 6A to 6C illustrate the configuration of the dynamic vibration absorber 50 according to the fourth exemplary embodiment. FIG. 6A is a view of the middle portion of the exposure device 14 (see FIG. 1) in the Z direction as seen from the downstream side in the X direction. FIG. 6B is a view of the middle portion of the exposure device 14 in the Z direction as seen in the direction of the arrow VIB in FIG. 6A. FIG. 6C is a view of the middle portion of the exposure device 14 in the Z direction as seen in the direction of the arrow VIC in FIG. 6A. In FIGS. 6A to 6C, the components of the LPH 140 other than the frame 145 are not illustrated.

In the dynamic vibration absorber 50 according to the fourth exemplary embodiment, the shape of the support portions 53 is different from that according to the third exemplary embodiment. In the dynamic vibration absorber 50 according to the fourth exemplary embodiment, the shape of the weight 51 is the same as that according to the third exemplary embodiment.

As illustrated in FIGS. 6A to 6C, the dynamic vibration absorber 50 according to the fourth exemplary embodiment has two support portions 53. The two support portions 53 are shaped so as to be symmetrical to each other with respect to the XY plane. The support portions 53 are shaped so as to be inclined with respect to the Y direction and the Z direction. Specifically, as illustrated in FIG. 6A, the support portions 53 are shaped so as to be inclined toward both sides of the LPH 140 in the Z direction as the support portions 53 extend toward the downstream side in the Y direction (toward the LPH 140). In other words, the support portion 53 positioned on the downstream side in the Z direction is shaped so as to be inclined toward the downstream side in the Z direction as the support portion 53 extends toward the downstream side in the Y direction, and the support portion 53 positioned on the upstream side in the Z direction is shaped so as to be inclined toward the upstream side in the Z direction as the support portion 53 extends toward the downstream side in the Y direction. Further additionally, each of the support portions 53 according to the fourth exemplary embodiment has a parallelepiped shape inclined with respect to the Y direction.

In the fourth exemplary embodiment, the support portions 53 are shaped so as to be inclined with respect to the Y direction and the Z direction, and thus the support portions 53 are subjected to shear deformation in the case where the weight 51 vibrates in the X direction, and the support portions 53 are subjected to compression deformation in the case where the weight 51 vibrates in the Y direction.

Consequently, the spring constant K of the support portions 53 for deformation in the Y direction is easily reduced to be close to the spring constant K thereof for deformation in the X direction compared to the first to third exemplary embodiments in which the support portions 53 are shaped so as to be symmetrical with respect to the ZX plane and subjected to compression deformation in the Y direction, for example. As a result, in the dynamic vibration absorber 50 according to the fourth exemplary embodiment, the natural frequency f of the dynamic vibration absorber 50 for vibration in the X direction and the natural frequency f thereof for vibration in the Y direction are easily brought close to each other compared to the first to third exemplary embodiments.

Then, the natural frequency f of the dynamic vibration absorber 50 are easily brought close to the natural frequency fa of the LPH 140 for vibration in the Y direction compared to the first to third exemplary embodiments even in the case where an adjustment is made such that the natural frequency f of the dynamic vibration absorber 50 and the natural frequency fa of the LPH 140 are generally equal to each other for vibration in the X direction, for example.

In the dynamic vibration absorber 50 according to the fourth exemplary embodiment, the weight 51 vibrates when vibration is input to the exposure device 14 from the outside. Vibration of the weight 51 repeatedly deforms the support portions 53 so that vibration is damped by the viscosity of the support portions 53. Consequently, vibration of the LPH 140 in the X direction is suppressed, and vibration of the LPH 140 in the Y direction is suppressed.

Fifth Exemplary Embodiment

Subsequently, a fifth exemplary embodiment of the present invention will be described. In the description of the fifth exemplary embodiment, components that are similar to those of the first exemplary embodiment are denoted by the same reference numerals to omit detailed description thereof.

Figure 7:
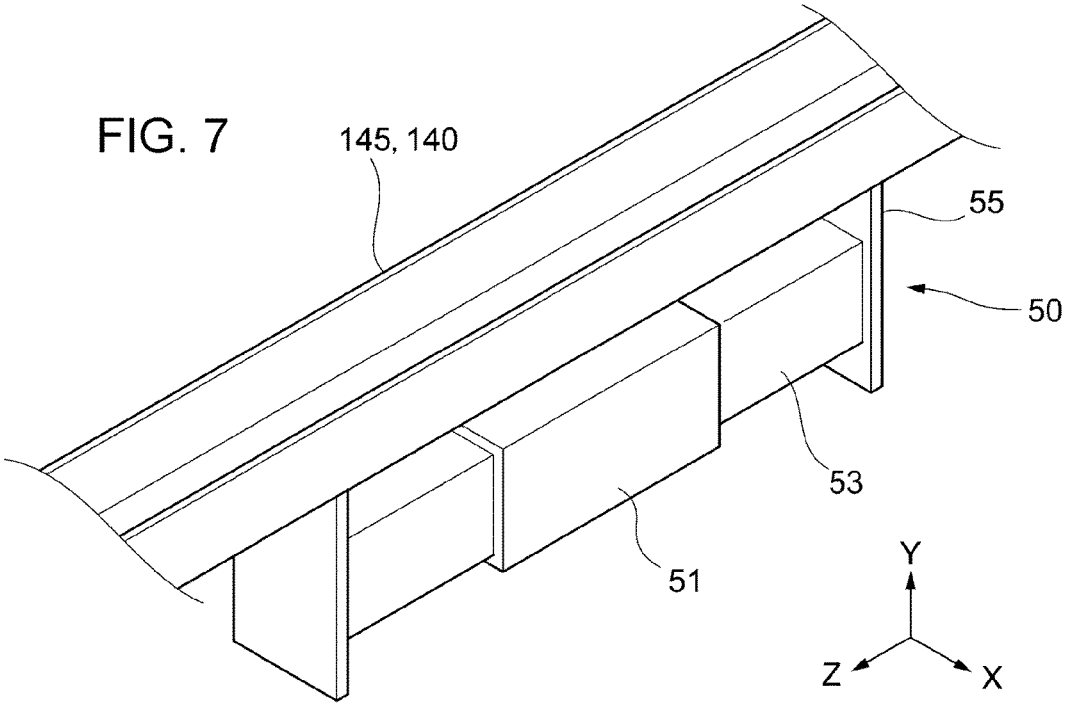
FIG. 7 illustrates the configuration of a dynamic vibration absorber according to a fifth exemplary embodiment, illustrating a middle portion of an exposure device in the Z direction as enlarged.

FIG. 7 illustrates the configuration of the dynamic vibration absorber 50 according to the fifth exemplary embodiment, illustrating the middle portion of the exposure device 14 (see FIG. 1) in the Z direction as enlarged. In FIG. 7, the components of the LPH 140 other than the frame 145 are not illustrated.

In the dynamic vibration absorber 50 according to the fifth exemplary embodiment, as illustrated in FIG. 7, the weight 51 and the support portions 53 are disposed side by side in the Z direction. In other words, the support portions 53 are disposed at both ends of the weight 51 in the Z direction.

The weight 51 according to the fifth exemplary embodiment has a quadrangular column shape that has surfaces that are parallel to the XY plane, the YZ plane, and the ZX plane and that has a square cross section that is perpendicular to the Z direction. Consequently, the weight 51 has a cross-sectional shape that is perpendicular to the Z direction and that is line-symmetrical with respect to axes that extend in the X direction and the Y direction.

As with the weight 51, each of the support portions 53 has a quadrangular column shape that has an axis along the Z direction, that has surfaces that are parallel to the XY plane, the YZ plane, and the ZX plane, and that has a square cross section that is perpendicular to the Z direction. Consequently, each of the support portions 53 has a cross-sectional shape that is perpendicular to the Z direction and that is symmetrical with respect to axes that extend in the X direction and the Y direction.

The support portions 53 are connected to surfaces of the weight 51 positioned at both end portions in the Z direction.

In the dynamic vibration absorber 50 according to the fifth exemplary embodiment, the support portions 53 are connected to an attachment member 55 provided at the middle portion of the frame 145 in the Z direction. Consequently, the weight 51 and the support portions 53 are attached to the middle portion of the frame 145 in the Z direction via the attachment member 55. Additionally, the weight 51 and the support portions 53 are attached by the attachment member 55 such that a gap is formed between the frame 145 of the LPH 140 and the weight 51 and the support portions 53.

The attachment member 55 is attached to the frame 145 of the LPH 140 to hold the weight 51 and the support portions 53 so as to face the LPH 140. The attachment member 55 is formed so as not to be elastically deformable even in the case where vibration is input from the outside of the exposure device 14. The attachment member 55 may be formed from a sheet metal made of a metal material such as steel or SUS, for example. The attachment member 55 may be integral with the frame 145.

In the fifth exemplary embodiment, the weight 51 and the support portions 53 are disposed side by side in the Z direction, and thus the support portions 53 are subjected to shear deformation both in the case where the weight 51 vibrates in the X direction and in the case where the weight 51 vibrates in the Y direction. Additionally, in the fifth exemplary embodiment, the positional relationship between the weight 51 and the support portions 53 is the same between the case where the weight 51 and the support portions 53 are seen in the X direction and the case where the weight 51 and the support portions 53 are seen in the Y direction.

Therefore, in the dynamic vibration absorber 50 according to the fifth exemplary embodiment, the spring constant K of the support portions 53 for deformation in the Y direction may be reduced so that the spring constant K of the support portions 53 for deformation in the X direction and the spring constant K thereof for deformation in the Y direction are generally equal to each other compared to the first to third exemplary embodiments in which the support portions 53 are subjected to compression deformation in the Y direction, for example. Consequently, the natural frequency f of the dynamic vibration absorber 50 for vibration in the X direction and the natural frequency f thereof for vibration in the Y direction are generally equal to each other.

As discussed above, the natural frequency fa of the LPH 140 for vibration in the X direction and the natural frequency fa thereof for vibration in the Y direction are close to each other. Thus, in the present exemplary embodiment, the support portions 53 are disposed so as to be subjected to shear deformation in both the X direction and the Y direction, and thus the natural frequency f of the dynamic vibration absorber 50 is easily brought close to the natural frequency fa of the LPH 140 for both vibration in the X direction and vibration in the Y direction compared to the first to third exemplary embodiments.

In the dynamic vibration absorber 50 according to the fifth exemplary embodiment, when vibration is input to the exposure device 14 from the outside, the weight 51 vibrates, and the support portions 53 are subjected to shear deformation. Then, vibration is damped by the viscosity of the support portions 53. Consequently, vibration of the LPH 140 in the X direction is suppressed, and vibration of the LPH 140 in the Y direction is suppressed.

In the dynamic vibration absorber 50 according to the fifth exemplary embodiment, the spring constants K for vibration in the X direction and vibration in the Y direction may be adjusted by changing the shape of the support portions 53. That is, in order to adjust the spring constants K of the support portions 53 for vibration in the X direction and vibration in the Y direction to different values, the respective lengths of the cross-sectional shape of the support portions 53 in the X direction and the Y direction may be varied to change the cross-sectional shape of the support portions 53 into a rectangle. For example, in the case where the spring constant K of the support portions 53 for vibration in the X direction is adjusted to be larger than that for vibration in the Y direction, the shape of the support portions 53 in a cross section that is perpendicular to the Z direction is changed into a rectangle that is longer in the X direction than in the Y direction.

Sixth Exemplary Embodiment

Subsequently, a sixth exemplary embodiment of the present invention will be described. In the description of the sixth exemplary embodiment, components that are similar to those of the first to fifth exemplary embodiments are denoted by the same reference numerals to omit detailed description thereof.

Figure 8:
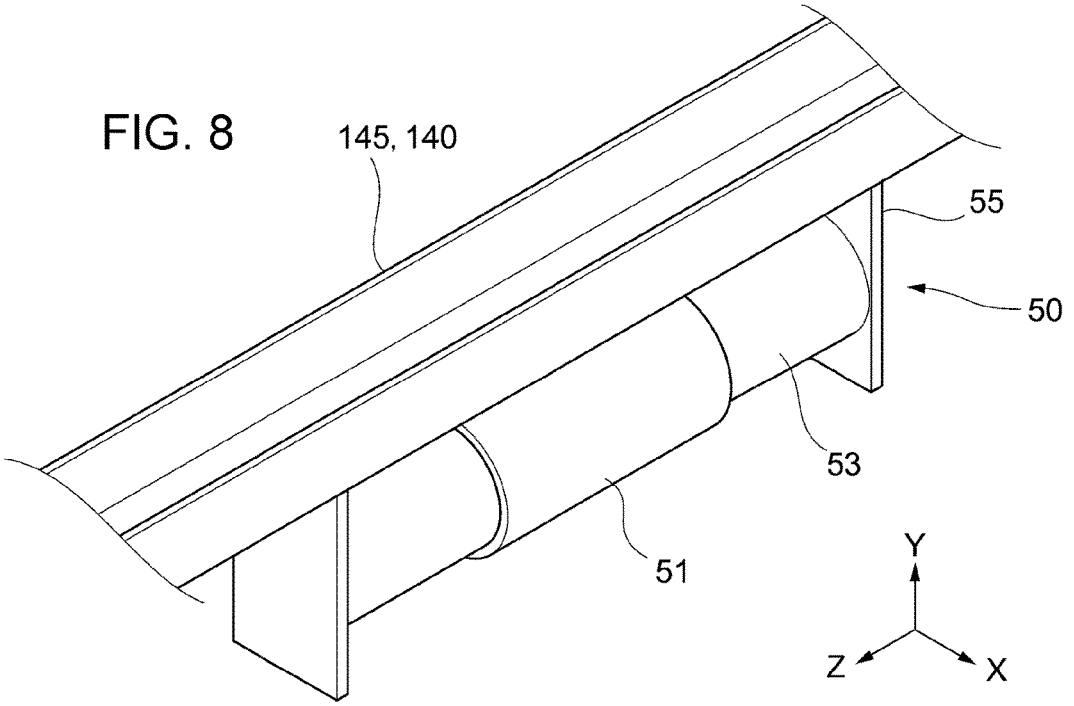
FIG. 8 illustrates the configuration of a dynamic vibration absorber according to a sixth exemplary embodiment, illustrating a middle portion of an exposure device in the Z direction as enlarged.

FIG. 8 illustrates the configuration of the dynamic vibration absorber 50 according to the sixth exemplary embodiment, illustrating the middle portion of the exposure device 14 (see FIG. 1) in the Z direction as enlarged. In FIG. 8, the components of the LPH 140 other than the frame 145 are not illustrated.

The dynamic vibration absorber 50 according to the sixth exemplary embodiment has the same configuration as the dynamic vibration absorber 50 according to the fifth exemplary embodiment except that the weight 51 and the support portions 53 are shaped differently.

In the dynamic vibration absorber 50 according to the sixth exemplary embodiment, the cross-sectional shape of the weight 51 and the support portions 53 along the XY plane differs from that in the dynamic vibration absorber 50 according to the fifth exemplary embodiment. Specifically, in the dynamic vibration absorber 50 according to the sixth exemplary embodiment, the weight 51 and the support portions 53 have a circular column shape that has an axis along the Z direction. The weight 51 and the support portions 53 have a circular shape in a cross section that is perpendicular to the Z direction.

In the sixth exemplary embodiment, as in the fifth exemplary embodiment, when vibration is input to the exposure device 14 from the outside, the weight 51 vibrates, and the support portions 53 are subjected to shear deformation. Then, vibration is damped by the viscosity of the support portions 53. Consequently, vibration of the LPH 140 in the X direction is suppressed, and vibration of the LPH 140 in the Y direction is suppressed.

In the dynamic vibration absorber 50 in which the weight 51 and the support portions 53 have a quadrangular column shape that has an axis along the Z direction, as in the fifth exemplary embodiment, the support portions 53 have different natural frequencies f for vibration in directions that intersect the X direction and the Y direction in a plane that is perpendicular to the Z direction from the natural frequency f for vibration in the X direction and vibration in the Y direction. In this case, the LPH 140 may be adversely affected in the case where the weight 51 vibrates in a direction that intersects the X direction and the Y direction, for example.

In the sixth exemplary embodiment, in contrast, the weight 51 and the support portions 53 have a circular column shape with a circular shape in a cross section that is perpendicular to the Z direction, and thus the support portions 53 have a generally equal natural frequency in any direction in a plane that is perpendicular to the Z direction. Consequently, an adverse effect on the LPH 140 is suppressed even in the case where the weight 51 vibrates in a direction that intersects the X direction and the Y direction, for example.

In the dynamic vibration absorber 50 according to the sixth exemplary embodiment, as in the fifth exemplary embodiment, the spring constants K for vibration in the X direction and vibration in the Y direction may be adjusted by changing the shape of the support portions 53. That is, in order to adjust the spring constants K of the support portions 53 for vibration in the X direction and vibration in the Y direction to different values, the respective lengths of the cross-sectional shape of the support portions 53 in the X direction and the Y direction may be varied to change the cross-sectional shape of the support portions 53 into an ellipse. For example, in the case where the spring constant K of the support portions 53 for vibration in the X direction is adjusted to be larger than that for vibration in the Y direction, the shape of the support portions 53 in a cross section that is perpendicular to the Z direction is changed into an ellipse that is longer in the X direction than in the Y direction.

In this case, the support portions 53 have different natural frequencies f in accordance with the direction of vibration in a plane that is perpendicular to the Z direction. However, the difference in the natural frequency f is small compared to the case where the support portions 53 have an angled shape in a cross section that is perpendicular to the Z direction as in the fifth exemplary embodiment, for example.

In the fifth and sixth exemplary embodiments, the weight 51 and the support portions 53 have the same shape as each other. However, the weight 51 and the support portions 53 may have different shapes from each other. That is, in the fifth and sixth exemplary embodiments, it is only necessary that at least the support portions 53 should be shaped as discussed above. This is because, with the support portions 53 shaped as discussed above, the spring constants K of the support portions 53 for vibration in the X direction and vibration in the Y direction may be made generally equal to each other to make the natural frequency f of the dynamic vibration absorber 50 generally equal to the natural frequency fa of the LPH 140.

From the viewpoint of suppressing fluctuations in vibration of the weight 51, however, the shape of the weight 51 is preferably generally equal to that of the support portions 53.

In the first to sixth exemplary embodiments, the support portions 53 which are both viscous and elastic are used as members that support the weight 51 so as to be vibratable. However, elastic members that are elastic and not viscous may be used in place of the support portions 53. This is because such elastic members may also have a spring constant K to suppress vibration of the LPH 140. Examples of such elastic members include compression springs. As discussed above, however, use of the support portions 53, which are not only elastic but also viscous, in the dynamic vibration absorber 50 may provide the dynamic vibration absorber 50 with a damping force for damping vibration. Consequently, use of the support portions 53 is preferable in order to suppress vibration of the LPH 140 better.

Seventh Exemplary Embodiment

Figure 9A:
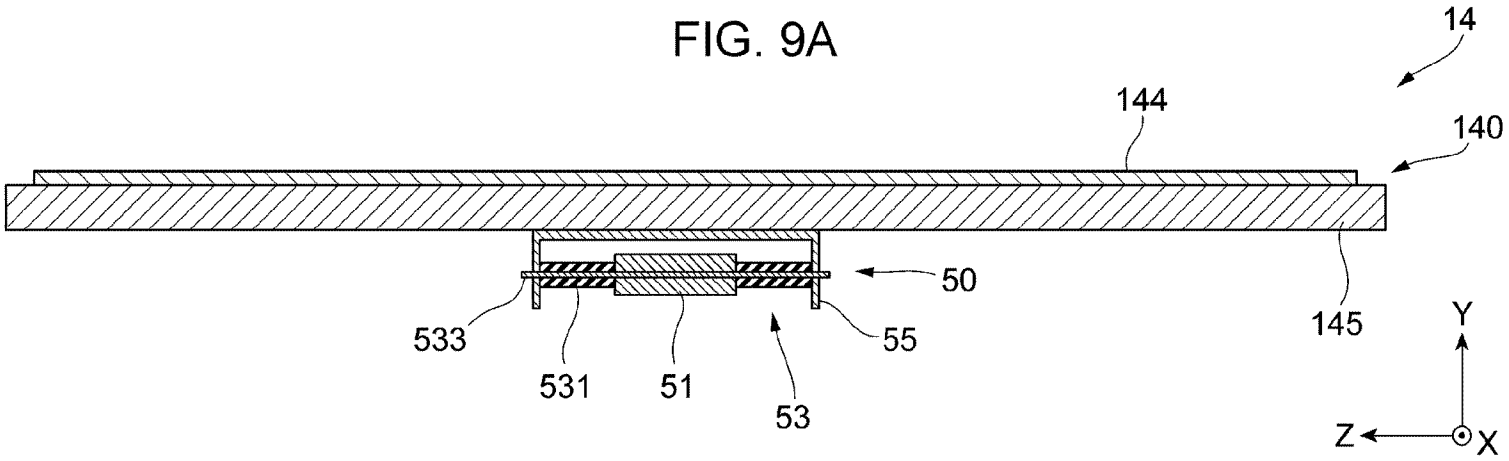
FIGS. 9A and 9B illustrate the configuration of a dynamic vibration absorber according to a seventh exemplary embodiment.
Figure 9B:
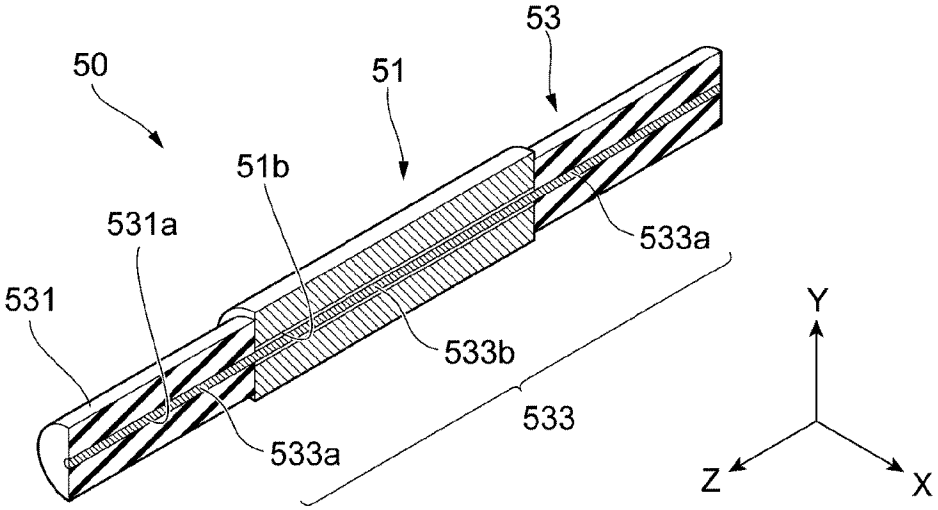

Subsequently, a seventh exemplary embodiment of the present invention will be described. In the description of the seventh exemplary embodiment, components that are similar to those of the first to sixth exemplary embodiments are denoted by the same reference numerals to omit detailed description thereof. FIGS. 9A and 9B illustrate the configuration of the dynamic vibration absorber 50 according to the seventh exemplary embodiment. FIG. 9A is a sectional view of the exposure device 14 taken along the YZ plane. FIG. 9B is a perspective sectional view of the weight 51 and the support portion 53 of the dynamic vibration absorber 50 taken along the YZ plane.

The dynamic vibration absorber 50 is attached to the middle portion of the frame 145 of the LPH 140 in the Z direction. The dynamic vibration absorber 50 does not contact the members other than the frame 145, and is raised from the other members. More specifically, the weight 51 and the support portion 53, to be discussed later, of the dynamic vibration absorber 50 are raised from the LPH 140.

As discussed above, the LPH 140 tends to vibrate more greatly at a location closer to the middle portion in the Z direction. Therefore, vibration of the LPH 140 is easily suppressed by providing the dynamic vibration absorber 50 in proximity to the middle portion of the frame 145 in the Z direction. In other words, the dynamic vibration absorber 50 is preferably attached to a position of the LPH 140 at which the amplitude of vibration is the greatest. A position in proximity to the middle portion in the Z direction refers to a range of one-third of the overall length in the Z direction at the middle portion in the Z direction, for example.

The dynamic vibration absorber 50 includes the weight 51 which is disposed so as to face the LPH 140 and which has a mass determined in advance, the support portion 53 which supports the weight 51 so as to be vibratable, and the attachment member 55 which attaches the weight 51 and the support portion 53 to the frame 145 of the LPH 140.

The attachment member 55 is attached to the frame 145 of the LPH 140 to hold the weight 51 and the support portion 53 so as to face the LPH 140. The attachment member 55 is formed so as not to be elastically deformable even in the case where vibration is input from the outside of the exposure device 14. The attachment member 55 may be formed from a sheet metal made of a metal material such as steel or SUS, for example. The attachment member 55 may be integral with the frame 145.

The weight 51 is a member that vibrates via the support portion 53 in the case where vibration is input to the LPH 140 from the outside.

The material forming the weight 51 is not specifically limited. However, a material that provides the weight 51 with the mass M that makes the natural frequency f of the dynamic vibration absorber 50 equal to the natural frequency fa of the LPH 140 on the basis of the formula (1) discussed above is selected. Examples of the material forming the weight 51 include a metal material such as steel or SUS and a resin material.

The weight 51 has a circular column shape that has an axis along the Z direction. Consequently, the weight 51 has a circular cross section in a plane that is perpendicular to the Z direction. A through hole 51*b* is formed along the Z direction at the center portion of the weight 51 to allow passage of a wire member 533, to be discussed later, of the support portion 53. The hole diameter of the through hole 51*b* is larger than the outside diameter of the wire member 533.

The shape of the weight 51 is not specifically limited. From the viewpoint of suppressing fluctuations in vibration of the weight 51, however, the weight 51 is preferably shaped so as to be symmetrical with respect to a plane (XY plane) that extends in the X direction and the Y direction, a plane (YZ plane) that extends in the Y direction and the Z direction, and a plane (ZX plane) that extends in the Z direction and the X direction. Above all, the weight 51 is preferably shaped so as to be symmetrical with respect to the center axis thereof which extends in the Z direction.

From the viewpoint of reducing the size of the exposure device 14, the width of the weight 51 in the X direction is preferably equal to or less than the width of the LPH 140 in the X direction.

The support portion 53 is a member that supports the weight 51 so as to be vibratable. In the present exemplary embodiment, the support portion 53 is formed from two members that are elastic with different temperature dependences. That is, the support portion 53 includes rubber members 531 that serve as an example of a first elastic portion that is viscous and elastic, and a wire member 533 that serves as an example of a second elastic portion that is elastic with a different temperature dependence from that of the rubber members 531.

The rubber members 531 support the weight 51 together with the wire member 533, and are deformable as the weight 51 vibrates.

As illustrated in FIGS. 9A and 9B, the rubber members 531 are attached to both ends of the weight 51 in the Z direction. In other words, in the present exemplary embodiment, the weight 51 and the rubber members 531 are disposed side by side in series with each other in the Z direction.

The rubber members 531 have a circular column shape that has an axis along the Z direction. Consequently, the rubber members 531 have a circular cross section in a plane that is perpendicular to the Z direction. A through hole 531*a* is formed along the Z direction at the center portion of each of the rubber members 531 to allow passage of the wire member 533. The hole diameter of the through holes 531*a* is slightly smaller than the outside diameter of the wire member 533.

The shape of the rubber members 531 is selected such that the spring constant K of the support portions 53 is a value determined in advance on the basis of the formula (1) discussed above. As with the weight 51, the support portions 531 are preferably shaped so as to be symmetrical with respect to the XY plane, the YZ plane, and the ZX plane. Above all, the rubber members 531 are preferably shaped so as to be symmetrical with respect to the center axis thereof which extends in the Z direction.

From the viewpoint of reducing the size of the exposure device 14, the width of the rubber members 531 in the X direction is preferably equal to or less than the width of the LPH 140 in the X direction.

The material of the rubber members 531 is not specifically limited as long as the material is viscous and elastic. Examples of the material include silicone rubber, butyl rubber, and nitrile rubber. Use of the rubber members 531 which are not only elastic but also viscous in the support portion 53 provides the effect of damping vibration to suppress vibration of the LPH 140 better.

The wire member 533 supports the weight 51 together with the rubber members 531, and is deformable as the weight 51 vibrates.

The wire member 533 is elastic with a different temperature dependence from that of the rubber members 531. Specifically, the wire member 533 has elasticity that is varied less with respect to temperature variations than that of the rubber members 531.

In general, a material that is less viscous has elasticity that is varied less with respect to temperature variations. Therefore, in the present exemplary embodiment, the wire member 533 is formed from a material that is less viscous than the material forming the rubber members 531. The wire member 533 may be formed from a material with a coefficient of loss (tan δ) that is equal to or less than 0.05 in the use temperature range of the image forming apparatus 1. The use temperature range of the image forming apparatus 1 refers to the temperature range of the environment in which the image forming apparatus 1 may be used, and may be a range of 0° C. or more and 60° C. or less, for example.

Specifically, the wire member 533 may be a wire made of a metal material or a resin material. The wire member 533 may also be formed from a rubber material, ceramics, carbon fibers, or wood in a rod shape, for example, as long as the above requirements are met.

As illustrated in FIGS. 9A and 9B, the wire member 533 is provided so as to penetrate the weight 51 and the two rubber members 531 in the Z direction. Specifically, the wire member 533 is provided so as to penetrate the through hole 51*b* formed in the weight 51 and the through holes 531*a* formed in the rubber members 531.

In the present exemplary embodiment, as discussed above, the diameter of the through holes 531*a* of the rubber members 531 is slightly smaller than the outside diameter of the wire member 533. Inserting the wire member 533 into the through holes 531*a* of the rubber members 531 deforms the rubber members 531 to bring the rubber members 531 and the wire member 533 into tight contact with each other. In other words, the rubber members 531 and the wire member 533 are attached to each other through fitting. In this case, it is not necessary to use an adhesive or the like in order to fix the rubber members 531 and the wire member 533 to each other.

Portions of the wire member 533 that pass through the rubber members 531 (hereinafter, both end portions 533*a* of the wire member 533) contact the rubber members 531 in the through holes 531*a*. Consequently, the both end portions 533*a* of the wire member 533 are deformed together with the rubber members 531 along with vibration of the weight 51.

On the other hand, a portion of the wire member 533 that passes through the weight 51 (hereinafter, a middle portion 533*b* of the wire member 533) does not contact the weight 51 in the through hole 51*b*. The middle portion 533*b* of the wire member 533 is deformed in the through hole 51*b* as the both end portions 533*a* of the wire member 533 are deformed together with the rubber members 531.

That is, in the present exemplary embodiment, the wire member 533 is deformed over the entire region along with vibration of the weight 51.

In the support portion 53 according to the present exemplary embodiment, the rubber members 531 and the both end portions 533*a* of the wire member 533 are disposed in parallel with the weight 51. In other words, the rubber members 531 and the both end portions 533*a* of the wire member 533 are provided as superposed on each other in some regions in the Z direction. Further additionally, the rubber members 531 and the both end portions 533*a* of the wire member 533 are disposed as superposed on each other in position (coordinate) in the Z direction.

Although discussed in detail later, with the rubber members 531 and the wire member 533 disposed in parallel with the weight 51 in the support portion 53, fluctuations in the spring constant K of the entire support portion 53 due to temperature variations are suppressed compared to a case where the rubber members 531 and the wire member 533 are disposed in series, that is, a case where the rubber members 531 and the wire member 533 are disposed side by side in the Z direction.

It is desirable that the center axis of the rubber members 531 which extends in the Z direction and the center axis of the wire member 533 which extends in the Z direction should coincide with each other in either of the case where the rubber members 531 and the wire member 533 are disposed in parallel and the case where the rubber members 531 and the wire member 533 are disposed in series. Further, it is desirable that such center axes and the center axis of the weight 51 which extends in the Z direction should coincide with each other.

In the case where the mass of the weight 51 is defined as M and the spring constant of the support portion 53 is defined as K, the dynamic vibration absorber 50 has the natural frequency f represented by the formula (1) discussed above. The spring constant K of the support portion 53 will be described in more detail later.

The mass M of the weight 51 and the spring constant K of the support portion 53 are preferably set such that the natural frequency f of the dynamic vibration absorber 50, which is represented by the above formula (1), is equal to the natural frequency (hereinafter, fa) of the LPH 140. Specifically, the mass M of the weight 51 and the spring constant K of the support portion 53 are preferably set such that the natural frequency f of the dynamic vibration absorber 50 for vibration in the X direction and vibration in the Y direction is equal to the natural frequency fa of the LPH 140.

With the natural frequency f of the dynamic vibration absorber 50 and the natural frequency fa of the LPH 140 equal to each other, the dynamic vibration absorber 50 (weight 51) vibrates in place of the LPH 140 to suppress resonance of the LPH 140 due to vibration from the outside of the exposure device 14. The phrase "equal natural frequencies" means that the difference between the natural frequency f of the dynamic vibration absorber 50 and the natural frequency fa of the LPH 140 is equal to or less than 10 Hz, for example.

In general, the properties of a viscoelastic member that is viscous and elastic (with relatively high viscosity and elasticity) such as rubber tend to be varied in accordance with the temperature. Specifically, the elasticity and the spring constant of a viscoelastic member such as rubber tend to be fluctuated in accordance with the temperature.

Therefore, in the case where a single viscoelastic member is used as the support portion 53 which supports the weight 51 so as to be vibratable in the dynamic vibration absorber 50 to be attached to the LPH 140, the elasticity and the spring constant of the viscoelastic member may be fluctuated in accordance with the temperature of use of the exposure device 14 (image forming apparatus 1), as a result of which the natural frequency of the dynamic vibration absorber 50 may be fluctuated. In this case, the difference between the natural frequency f of the dynamic vibration absorber 50 and the natural frequency fa of the LPH 140 may be so large that the effect of the dynamic vibration absorber 50 in suppressing vibration of the LPH 140 may be insufficient, depending on the temperature of use of the exposure device 14 (image forming apparatus 1).

In the dynamic vibration absorber 50 according to the present exemplary embodiment, in contrast, the rubber members 531 and the wire member 533 which are elastic with different temperature dependences are used as the support portion 53 as discussed above. Consequently, fluctuations in the spring constant K of the entire support portion 53 according to the temperature are suppressed compared to a case where a single viscoelastic member is used as the support portion 53, for example.

Figure 10:
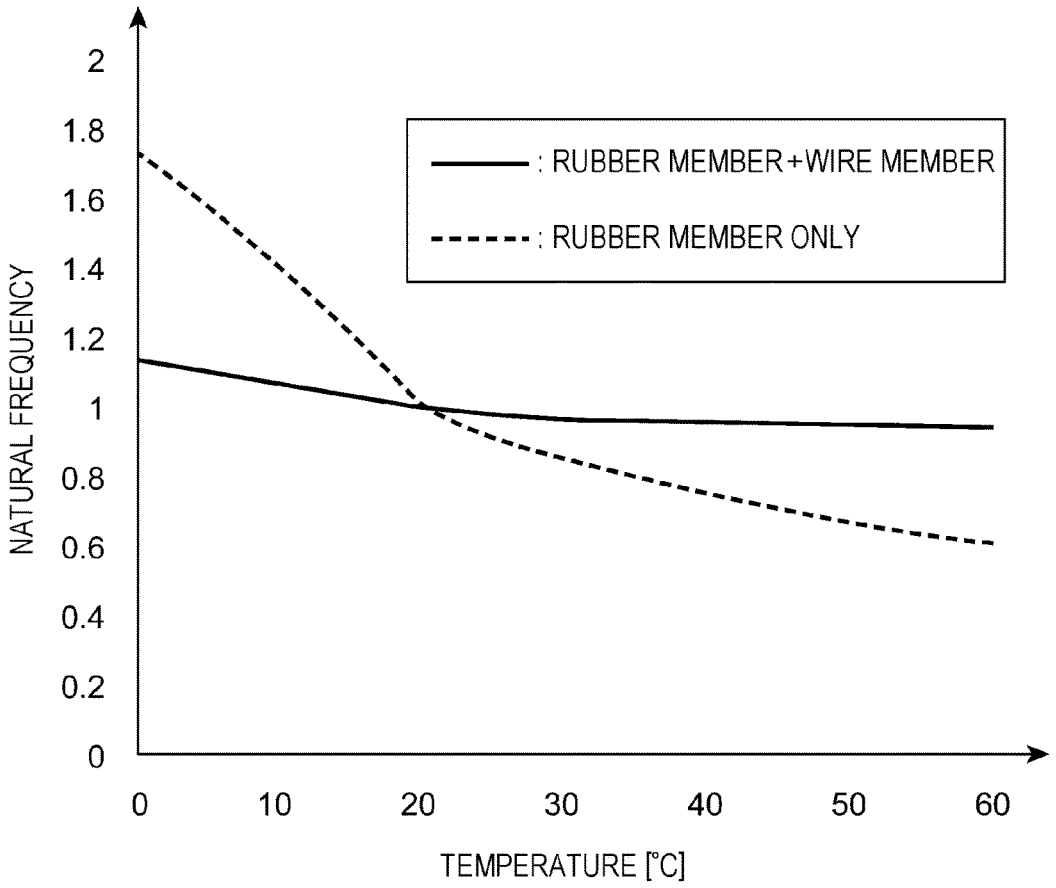
FIG. 10 illustrates temperature variations in the natural frequency of the dynamic vibration absorber according to the seventh exemplary embodiment and the natural frequency of the dynamic vibration absorber for a case where a wire member is not provided in a support member.

FIG. 10 illustrates temperature variations in the natural frequency f of the dynamic vibration absorber 50 according to the seventh exemplary embodiment and the natural frequency f of the dynamic vibration absorber 50 for a case where the wire member 533 is not provided in the support member 53. FIG. 10 illustrates temperature variations for a case where the natural frequency f of the dynamic vibration absorber 50 at 20° C. is determined as 1.

As illustrated in FIG. 10, fluctuations in the natural frequency f according to the temperature may be suppressed by using the rubber members 531 and the wire member 533 as the support portion 53 compared to a case where the wire member 533 is not provided (only the rubber members 531 are used) as the support portion 53. Additionally, fluctuations in the natural frequency f are suppressed in a range of 0° C. or more and 60° C. or less, which is the temperature of use of the exposure device 14 (image forming apparatus 1), by using the rubber members 531 and the wire member 533 as the support portion 53.

In the support portion 53 according to the present exemplary embodiment, as discussed above, the rubber members 531 and the both end portions 533*a* of the wire member 533 are disposed in parallel with the weight 51.

The spring constant of the rubber members 531 of the support portion 53 is defined as K1, and the spring constant of the wire member 533 is defined as K2 (in general, K1 is less than K2 since the elasticity of the wire member 533 is less dependent on the temperature than that of the rubber members 531). Then, in the case where the rubber members 531 and the wire member 533 (both end portions 533*a*) are disposed in parallel, the spring constant K of the entire support portion 53 is roughly represented as $K=K1+K2$. In the case where the rubber members 531 and the wire member 533 (both end portions 533*a*) are disposed in series, on the other hand, the spring constant K of the entire support portion 53 is roughly represented as $K=K1 \cdot K2/(K1+K2)$.

In the present exemplary embodiment, fluctuations in the spring constant K of the entire support portion 53 according to temperature variations are suppressed with the rubber members 531 and the wire member 533 disposed in parallel with the weight 51, compared to a case where the rubber members 531 and the wire member 533 are disposed in series. Consequently, fluctuations in the natural frequency f of the dynamic vibration absorber 50 according to temperature variations are suppressed better than a case where the rubber members 531 and the wire member 533 are disposed in series with the weight 51.

Subsequently, the function of the dynamic vibration absorber 50 will be described. When vibration is input to the exposure device 14 from the outside, the weight 51 of the dynamic vibration absorber 50 vibrates in place of the LPH 140. Vibration of the weight 51 repeatedly deforms the rubber members 531 and the wire member 533 of the support portion 53.

In the dynamic vibration absorber 50 according to the present exemplary embodiment, as discussed above, the weight 51 and the rubber members 531 and the both end portions 533*a* of the wire member 533 of the support portion 53 are disposed side by side in the Z direction. Consequently, in the case where the weight 51 vibrates in the X direction or the Y direction, the rubber members 531 and the wire member 533 are repeatedly deformed in the shear direction. Then, vibration is damped by the viscosity of the rubber members 531 of the support portion 53 with the rubber members 531 deformed.

Additionally, in the present exemplary embodiment, the rubber members 531 and the wire member 533 are subjected to shear deformation in both the X direction and the Y direction because of vibration of the weight 51. Consequently, the natural frequency f of the dynamic vibration absorber 50 for vibration in the X direction and the natural frequency f thereof for vibration in the Y direction are equal to each other. Normally, the natural frequency fa of the LPH 140 for vibration in the X direction and the natural frequency fa thereof for vibration in the Y direction are close to each other, although depending on the structure of the LPH 140. Thus, in the present exemplary embodiment, the rubber members 531 and the wire member 533 are disposed such that both the rubber members 531 and the wire member 533 are subjected to shear deformation, and thus the natural frequency f of the dynamic vibration absorber 50 is easily brought close to the natural frequency fa of the LPH 140 for both vibration in the X direction and vibration in the Y direction compared to a case where the rubber members 531 and the wire member 533 are disposed such that either the rubber members 531 or the wire member 533 is subjected to compression deformation, for example.

Figure 11:
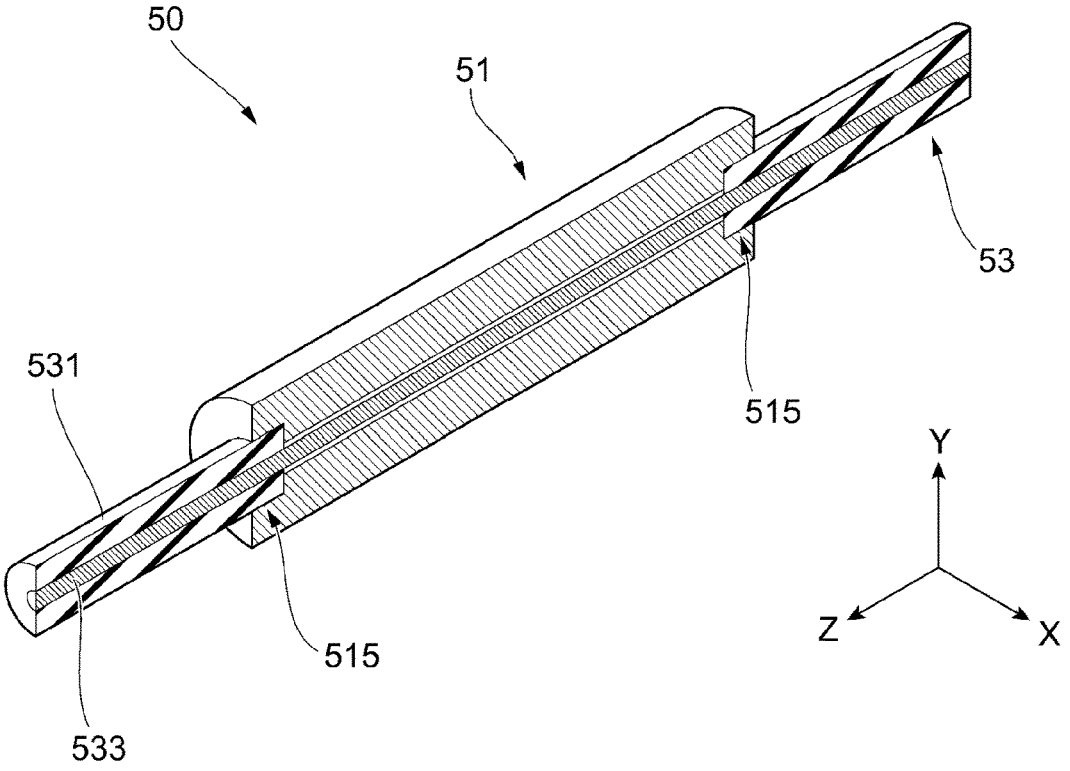
FIG. 11 illustrates a dynamic vibration absorber according to a modification of the seventh exemplary embodiment.

Subsequently, the dynamic vibration absorber 50 according to a modification of the seventh exemplary embodiment will be described. FIG. 11 illustrates the dynamic vibration absorber 50 according to a modification of the seventh exemplary embodiment, and is a perspective sectional view of the weight 51 and the support portion 53 of the dynamic vibration absorber 50 taken along the YZ plane.

In the dynamic vibration absorber 50 illustrated in FIG. 11, the method of connection between the weight 51 and the rubber members 531 of the support portion 53 differs from that in the example illustrated in FIGS. 9A and 9B.

In the dynamic vibration absorber 50 illustrated in FIG. 11, attachment holes 515 for attachment of the rubber members 531 are formed at both ends of the weight 51 in the Z direction. The attachment holes 515 are holes in a circular column shape that open in the Z direction. The diameter of the attachment holes 515 is slightly smaller than the outside diameter of the rubber members 531. Consequently, in the dynamic vibration absorber 50 illustrated in FIG. 11, the rubber members 531 are inserted into the attachment holes 515 of the weight 51 to deform the rubber members 531 so that the weight 51 and the rubber members 531 are brought into tight contact with each other. In other words, the rubber members 531 are attached to the weight 51 through fitting. In this case, it is not necessary to use an adhesive or the like in order to fix the weight 51 and the rubber members 531 to each other.

In the dynamic vibration absorber 50 according to the present exemplary embodiment, the weight 51, the rubber members 531, and the wire member 533 may be formed through integral molding. Specifically, a material for forming the rubber members 531 is poured into a mold, in which the weight 51 and the wire member 533 are installed in advance, to be molded. Consequently, the dynamic vibration absorber 50 in which the weight 51, the rubber members 531, and the wire member 533 are integrated may be obtained.

By forming the dynamic vibration absorber 50 through integral molding, the wire member 533 may be disposed inside the rubber members 531 while suppressing bend or the like of the wire member 533 even in the case where the wire member 533 is so thin that it is difficult to insert the wire member 533 into the rubber members 531, for example.

Eighth Exemplary Embodiment

Figure 12:
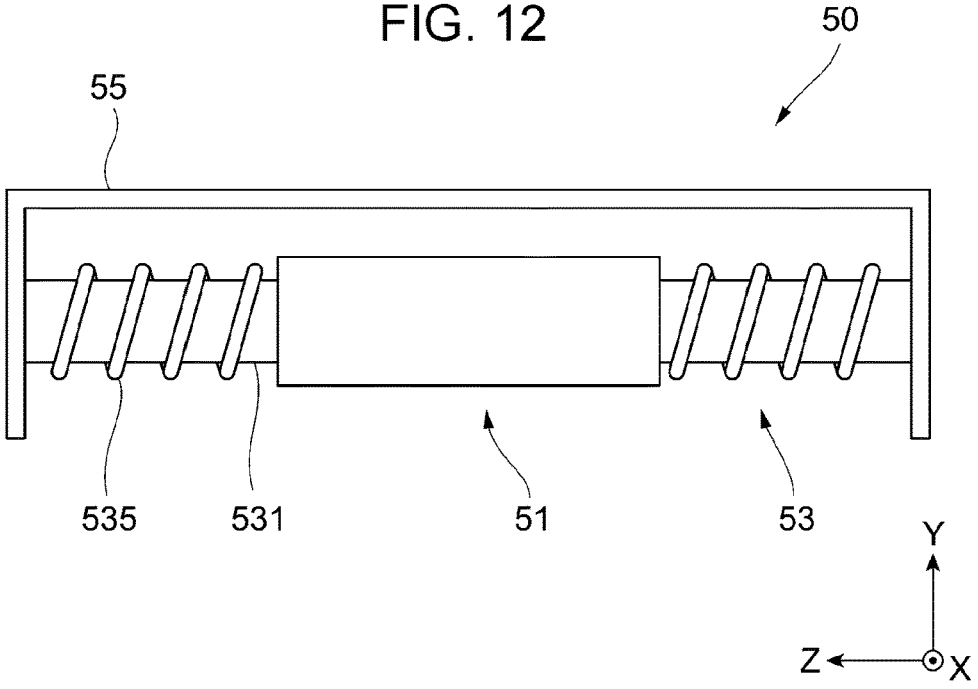
FIG. 12 illustrates the configuration of a dynamic vibration absorber according to an eighth exemplary embodiment.

Subsequently, an eighth exemplary embodiment of the present invention will be described. FIG. 12 illustrates the configuration of the dynamic vibration absorber 50 according to the eighth exemplary embodiment, illustrating the dynamic vibration absorber 50, which is attached to the LPH 140 (see FIGS. 2A and 2B), as seen in the X direction. In the description of the eighth exemplary embodiment, components that are similar to those of the first to seventh exemplary embodiments are denoted by the same reference numerals to omit detailed description thereof.

In the dynamic vibration absorber 50 according to the eighth exemplary embodiment, as illustrated in FIG. 12, the configuration of the support portion 53 is different from that according to the first to seventh exemplary embodiments. Specifically, the support portion 53 according to the eighth exemplary embodiment includes coil members 535 in place of the wire member 533 (see FIGS. 9A and 9B) according to the seventh exemplary embodiment. In other words, the support portion 53 according to the eighth exemplary embodiment includes rubber members 531 that serve as an example of a first elastic portion that is viscous and elastic, and coil members 535 that serve as an example of a second elastic portion that is elastic with a different temperature dependence from that of the rubber members 531.

The coil members 535 support the weight 51 together with the rubber members 531, and are deformable as the weight 51 vibrates.

The coil members 535 are elastic with a different temperature dependence from that of the rubber members 531. The coil members 535 are less viscous than the material forming the rubber members 531. The coil members 535 are preferably formed from a material with a coefficient of loss (tan δ) that is equal to or less than 0.05 in the use temperature range of the image forming apparatus 1.

Specifically, the coil members 535 may be a metal material, a resin material, or the like shaped spirally.

As illustrated in FIG. 12, the coil members 535 are provided so as to be wound spirally around the outer periphery of the rubber members 531 in a circular column shape.

Also in the eighth exemplary embodiment, as in the seventh exemplary embodiment, the rubber members 531 and the coil members 535 are disposed in parallel with the weight 51. Consequently, fluctuations in the spring constant K of the entire support portion 53 according to temperature variations are suppressed compared to a case where the rubber members 531 and the coil members 535 are disposed in series with the weight 51, for example.

Ninth Exemplary Embodiment

Figure 13A:
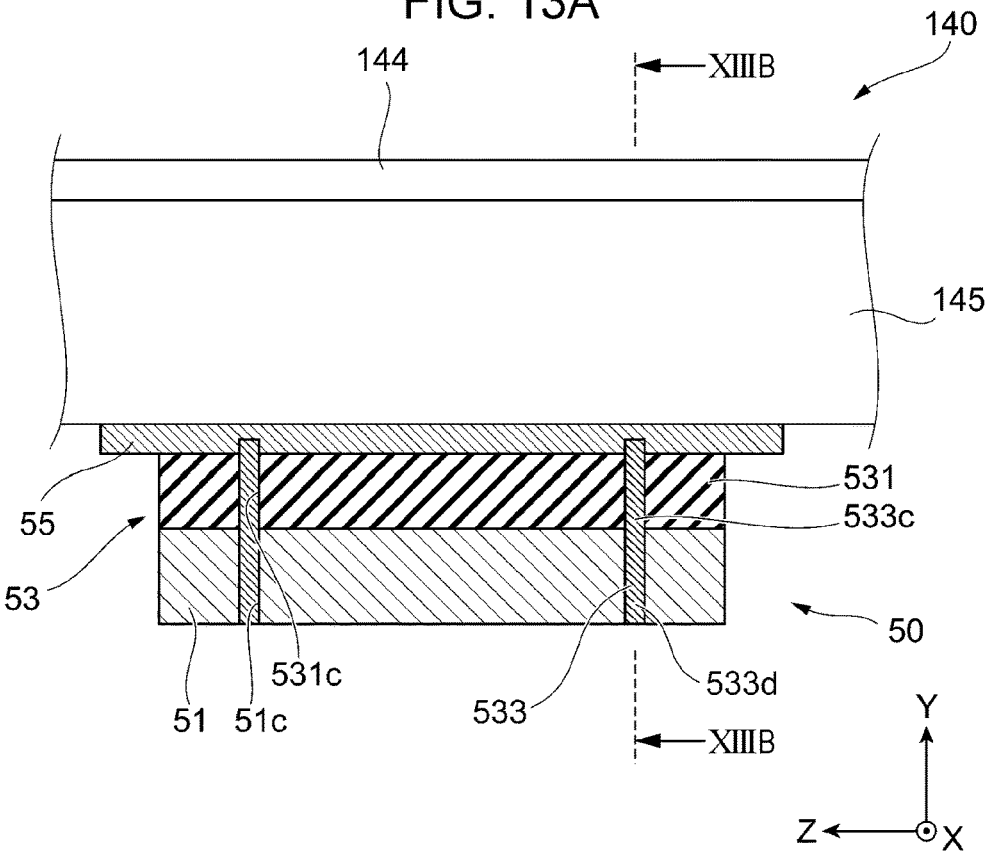
FIGS. 13A and 13B illustrate the configuration of a dynamic vibration absorber according to a ninth exemplary embodiment.
Figure 13B:
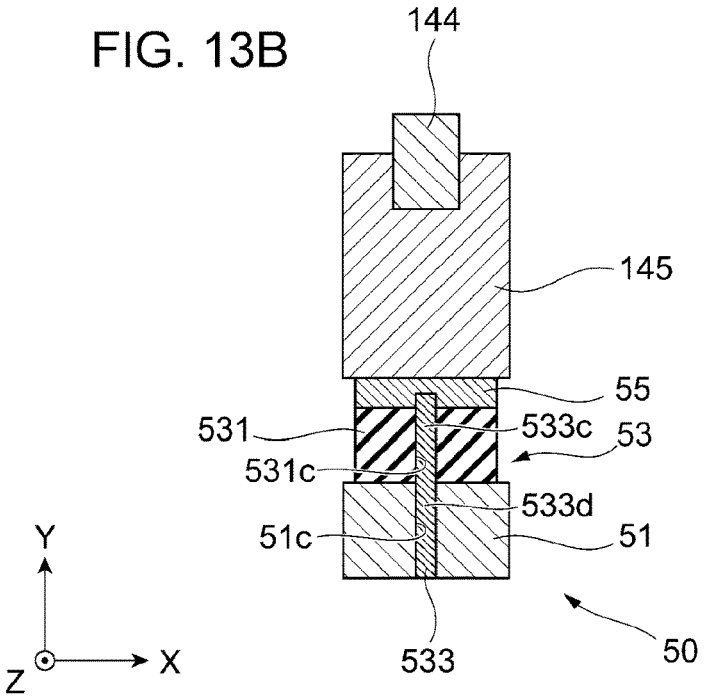

Subsequently, a ninth exemplary embodiment of the present invention will be described. FIGS. 13A and 13B illustrate the configuration of the dynamic vibration absorber 50 according to the ninth exemplary embodiment. FIG. 13A is a sectional view of the weight 51 and the support portion 53 of the dynamic vibration absorber 50 taken along the YZ plane. FIG. 13B is a cross-sectional view taken along the line XIIIB-XIIIB in FIG. 13A.

In the seventh and eighth exemplary embodiments discussed above, the weight 51 and the support portions 53 are disposed side by side in the Z direction, and the dynamic vibration absorber 50 suppresses vibration of the LPH 140 in the X direction and vibration thereof in the Y direction. In the dynamic vibration absorber 50 according to the ninth exemplary embodiment, in contrast, the weight 51 and the support portion 53 are disposed side by side in the Y direction. The dynamic vibration absorber 50 according to the ninth exemplary embodiment preferentially suppresses vibration of the LPH 140 in the X direction (sub scanning direction).

In the dynamic vibration absorber 50 according to the ninth exemplary embodiment, as illustrated in FIGS. 13A and 13B, the weight 51 and the support portions 53 are disposed side by side in the Y direction.

The weight 51 has a rectangular parallelepiped shape having surfaces that are parallel to the XY plane, the YZ plane, and the ZX plane. More specifically, the weight 51 has a rectangular parallelepiped shape which is long in the Z direction and in which the thickness in the Y direction is smaller than the width in the X direction in a cross section that is perpendicular to the Z direction. A surface of the weight 51 positioned on the downstream side in the Y direction is attached to the rubber member 531 of the support portion 53.

The weight 51 is formed with a through hole 51*c* for insertion of the wire member 533 of the support portion 53.

As in the seventh exemplary embodiment, the support portion 53 is formed from two members that are elastic with different temperature dependences. That is, the support portion 53 includes a rubber member 531 that is viscous and elastic, and a wire member 533 that is elastic with a different temperature dependence from that of the rubber member 531. Consequently, fluctuations in the spring constant K of the entire support portion 53 according to the temperature are suppressed compared to a case where a single viscoelastic member is used as the support portion 53, for example.

The rubber member 531 of the support portion 53 has a rectangular parallelepiped shape having surfaces that are parallel to the XY plane, the YZ plane, and the ZX plane. More specifically, as with the weight 51, the rubber member 531 has a rectangular parallelepiped shape which is long in the Z direction and in which the thickness in the Y direction is smaller than the width in the X direction in a cross section that is perpendicular to the Z direction.

The rubber member 531 is formed with a through hole 531*c* for insertion of the wire member 533.

The wire member 533 of the support portion 53 is provided along the Y direction so as to penetrate the weight 51 and the rubber member 531. Specifically, the wire member 533 is inserted into the through hole 51*c* formed in the weight 51 and the through hole 531*c* formed in the rubber member 531.

Also in the present exemplary embodiment, as in the seventh exemplary embodiment, a portion of the wire member 533 that passes through the rubber member 531 (hereinafter, a root portion 533*c* of the wire member 533) is deformed together with the rubber member 531 along with vibration of the weight 51. On the other hand, a portion of the wire member 533 that passes through the weight 51 (hereinafter, a distal end portion 533*d* of the wire member 533) is not deformed even if the weight 51 vibrates.

Also in the support portion 53 according to the present exemplary embodiment, as in the seventh exemplary embodiment, the rubber member 531 and the root portion 533*c* of the wire member 533 are disposed in parallel with the weight 51. Then, fluctuations in the spring constant K of the entire support portion 53 according to temperature variations are suppressed with the rubber member 531 and the wire member 533 disposed in parallel with the weight 51 in the support portion 53, compared to a case where the rubber member 531 and the wire member 533 are disposed in series.

In the dynamic vibration absorber 50 according to the ninth exemplary embodiment, the weight 51 and the support portion 53 are provided side by side in the Y direction. Consequently, the support portion 53 is subjected to compression deformation in the case where the weight 51 vibrates in the Y direction. Meanwhile, the support portion 53 is subjected to shear deformation in the case where the weight 51 vibrates in the X direction. In this case, unlike a case where the support portion 53 is subjected to shear deformation in both the X direction and the Y direction, a difference is caused between the natural frequency f of the dynamic vibration absorber 50 for vibration in the X direction and the natural frequency f thereof for vibration in the Y direction. As discussed above, the natural frequency fa of the LPH 140 for vibration in the X direction and the natural frequency fa thereof for vibration in the Y direction are close to each other. Therefore, in the ninth exemplary embodiment, it is difficult to bring the natural frequency f of the dynamic vibration absorber 50 closer to the natural frequency fa of the LPH 140 for both vibration in the X direction and vibration in the Y direction.

Thus, in the ninth exemplary embodiment, an adjustment is preferably made such that the natural frequency f of the dynamic vibration absorber 50 and the natural frequency fa of the LPH 140 are equal to each other for vibration in the X direction in which vibration of the LPH 140 tends to affect the image quality.

When vibration is input to the exposure device 14 (see FIGS. 2A and 2B), the weight 51 of the dynamic vibration absorber 50 vibrates in place of the LPH 140. Vibration of the weight 51 repeatedly deforms the rubber member 531 and the wire member 533 of the support portion 53.

Consequently, vibration of the LPH 140 in the X direction is principally absorbed and damped by the dynamic vibration absorber 50.

Tenth Exemplary Embodiment

Figure 14A:
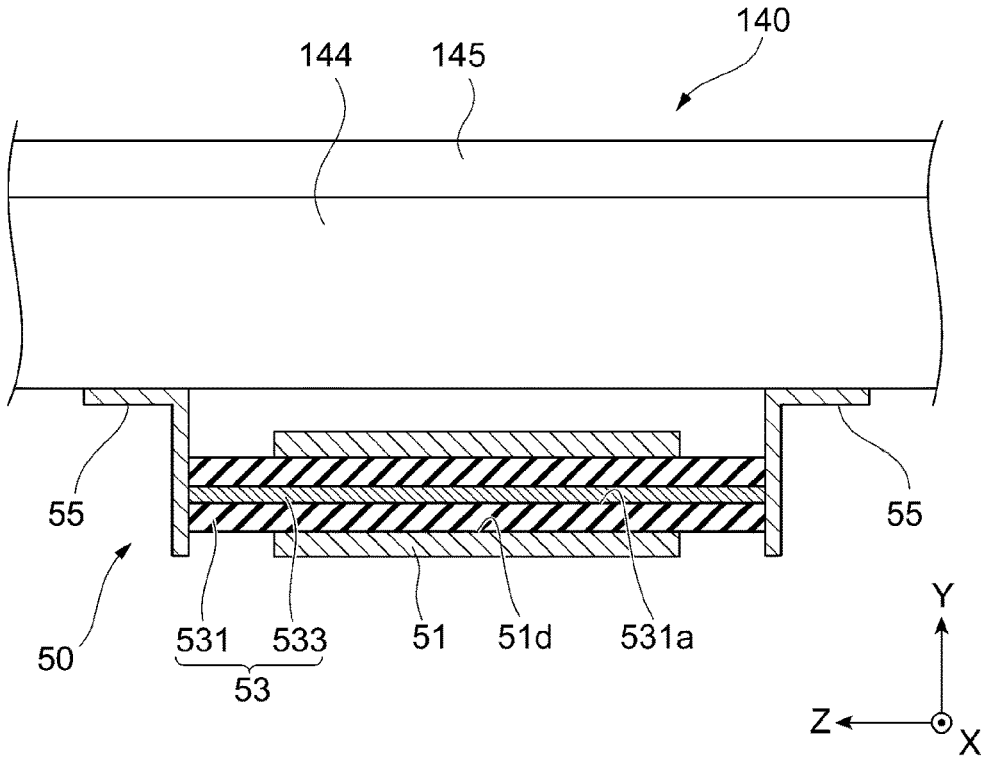
FIGS. 14A and 14B illustrate the configuration of a dynamic vibration absorber according to a tenth exemplary embodiment.
Figure 14B:
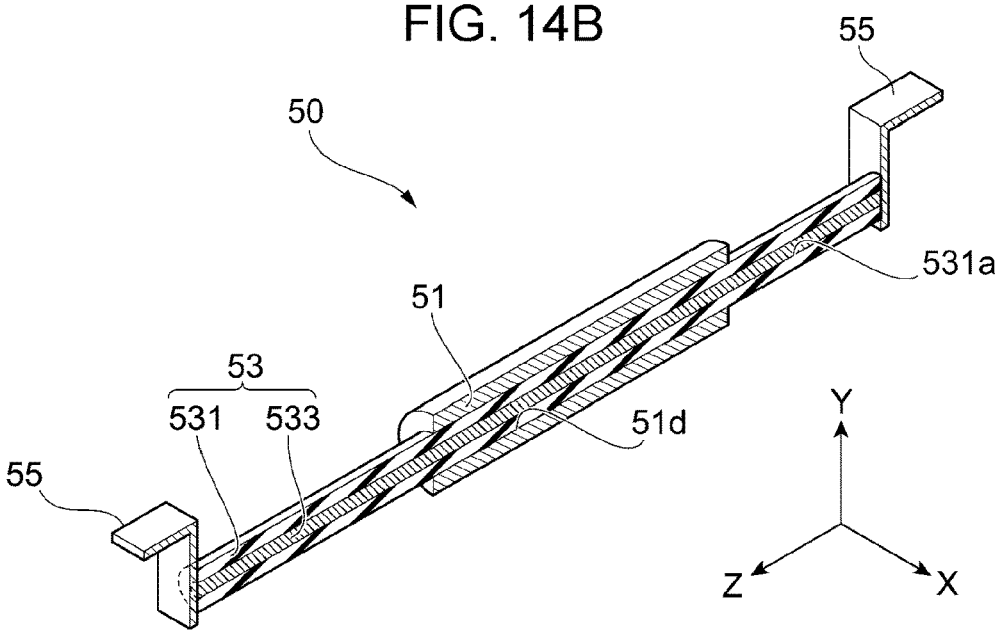

Subsequently, a tenth exemplary embodiment of the present invention will be described. In the description of the tenth exemplary embodiment, components that are similar to those of the first to ninth exemplary embodiments are denoted by the same reference numerals to omit detailed description thereof. FIGS. 14A and 14B illustrate the configuration of the dynamic vibration absorber 50 according to the tenth exemplary embodiment. FIG. 14A illustrates the dynamic vibration absorber 50 as seen from the downstream side in the X direction. FIG. 14B is a perspective sectional view of the weight 51 and the support portion 53 of the dynamic vibration absorber 50 taken along the YZ plane. In FIG. 14A, the rod lens array 144 and the frame 145 of the LPH 140 are also illustrated in addition to the dynamic vibration absorber 50.

In the dynamic vibration absorber 50 according to the seventh exemplary embodiment discussed above, the rubber members 531 of the support portion 53 are provided at both ends of the weight 51 in the Z direction. In other words, in the seventh exemplary embodiment, the wire member 533 of the support portion 53 is continuous from one end to the other end of the weight 51 in the Z direction, and the rubber members 531 of the support portion 53 are separated from each other in the Z direction by the weight 51. In the dynamic vibration absorber 50 according to the tenth exemplary embodiment, in contrast, not only the wire member 533 of the support portion 53 but also the rubber member 531 of the support portion 53 is continuous from one end to the other end of the weight 51 in the Z direction.

Specifically, as illustrated in FIGS. 14A and 14B, the weight 51 according to the tenth exemplary embodiment is formed with an opening 51*d* in a circular column shape that extends in the Z direction, and has a cylindrical shape as a whole. Consequently, the weight 51 has a circular ring cross section in a plane that is perpendicular to the Z direction. Although discussed in detail later, the rubber member 531 of the support portion 53 is disposed in the opening 51*d* of the weight 51 so as to penetrate the weight 51. The diameter of the opening 51*d* is slightly smaller than the outside diameter of the rubber member 531 of the support portion 53.

The overall shape of the weight 51 and the shape of the opening 51*d* are not specifically limited as long as the opening 51*d* which allows the rubber member 531 of the support portion 53 to penetrate the weight 51 is formed along the Z direction. From the viewpoint of suppressing fluctuations in vibration of the weight 51, however, the shape of the weight 51 is preferably symmetrical with respect to the center axis thereof which extends in the axial direction.

The support portion 53 which serves as an example of an elastic portion includes the rubber member 531 which serves as an example of a first elastic portion that is viscous and elastic, and the wire member 533 which serves as an example of a second elastic portion that is elastic with a different temperature dependence from that of the rubber member 531. Consequently, with the dynamic vibration absorber 50 according to the present exemplary embodiment, fluctuations in the spring constant K of the entire support portion 53 are suppressed compared to a case where a single viscoelastic member is used as the support portion 53.

The rubber member 531 has a circular column shape that has an axis along the Z direction. Consequently, the rubber member 531 has a circular cross section in a plane that is perpendicular to the Z direction. In addition, the length of the rubber member 531 along the Z direction is larger than the length of the weight 51 along the Z direction.

Further, a through hole 531*a* is formed along the Z direction at the center portion of the rubber member 531 to allow passage of the wire member 533. The hole diameter of the through hole 531*a* is slightly smaller than the outside diameter of the wire member 533.

Furthermore, as illustrated in FIGS. 14A and 14B, the rubber member 531 is provided so as to penetrate the opening 51*d*, which is formed in the weight 51, in the Z direction. Additionally, the rubber member 531 is provided continuously from one end to the other end of the weight 51 in the Z direction by penetrating the opening 51*d*. Both end portions of the rubber member 531 in the Z direction project from both end portions of the weight 51 in the Z direction.

As discussed above, the outside diameter of the rubber member 531 (outside diameter before insertion into the weight 51) is slightly larger than the diameter of the opening 51*d* of the weight 51. Therefore, when the rubber member 531 is inserted into the opening 51*d* of the weight 51, the rubber member 531 is deformed so that the rubber member 531 and the weight 51 are brought into tight contact with each other by the elastic restoring force of the rubber member 531. Consequently, the weight 51 is fixed with respect to the rubber member 531 over the entire region in the Z direction, which suppresses removal between the weight 51 and the rubber member 531.

In the description of the present exemplary embodiment, the weight 51 being fixed with respect to the rubber member 531 means that the weight 51 and the rubber member 531 tightly contact each other directly or via an adhesive or the like in the region of fixation so that the position of the weight 51 relative to the rubber member 531 is not changed in the case where the weight 51 vibrates. The method of fixing the weight 51 with respect to the rubber member 531 is not specifically limited, and may use the elastic restoring force of the rubber member 531 as in the present exemplary embodiment, or use an adhesive, a double-sided tape, or the like, for example.

The wire member 533 is formed from a material, the elasticity of which is varied less with respect to temperature variations than that of the rubber member 531. The wire member 533 is provided so as to penetrate the through hole 531*a* which is formed in the rubber member 531. In this example, the length of the rubber member 531 along the Z direction is equal to the length of the wire member 533 along the Z direction.

The wire member 533 is provided so as to penetrate the through hole 531*a* which is formed in the rubber member 531.

In the support portion 53 according to the present exemplary embodiment, the rubber member 531 and the wire member 533 are disposed in parallel with the weight 51. In other words, the rubber member 531 and the wire member 533 are provided as superposed on each other over the entire region in the Z direction.

Consequently, fluctuations in the spring constant K of the entire support portion 53 according to temperature variations are suppressed compared to a case where the rubber member 531 and the wire member 533 are disposed in series with the weight 51, for example.

In the dynamic vibration absorber 50 according to the present exemplary embodiment, the rubber member 531 of the support portion 53 is continuous from one end to the other end of the weight 51 in the Z direction. Consequently, the volume of the rubber member 531 may be increased while suppressing an increase in the size of the entire dynamic vibration absorber 50 compared to a case where the rubber members 531 are separated from each other in the Z direction by the weight 51 as in the seventh exemplary embodiment, for example.

As a result, the effect of the dynamic vibration absorber 50 in damping vibration of the LPH 140 because of the viscosity of the rubber member 531 is increased.

Figure 15:
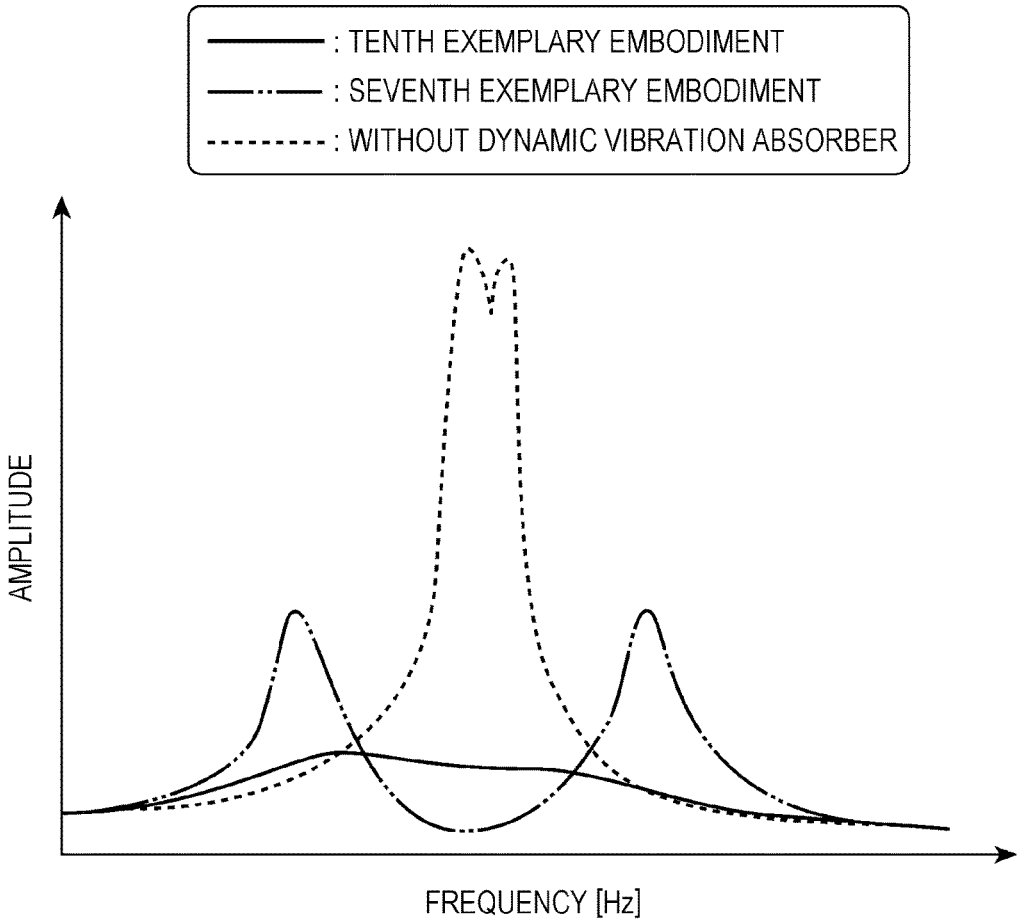
FIG. 15 illustrates the characteristics of vibration of an LPH, illustrating the relationship between the vibration frequency and the amplitude of the LPH.

FIG. 15 illustrates the characteristics of vibration of the LPH 140, illustrating the relationship between the vibration frequency and the amplitude of the LPH 140.

In the case where the dynamic vibration absorber 50 is not attached to the LPH 140 in the exposure device 14, as indicated by the broken line in FIG. 15, the amplitude at the natural frequency fa of the LPH 140 is increased by resonance with vibration from the outside.

If the dynamic vibration absorber 50 according to the seventh exemplary embodiment illustrated in FIGS. 9A and 9B is attached to the LPH 140, on the other hand, as indicated by the double-dashed line in FIG. 15, the amplitude is reduced at the natural frequency fa of the LPH 140.

With the dynamic vibration absorber 50 according to the seventh exemplary embodiment, the amplitude may be increased in a frequency region (a natural frequency fb of the LPH 140 with the dynamic vibration absorber 50 attached thereto) that is adjacent to the natural frequency fa as indicated in FIG. 15, although the amplitude at the natural frequency fa of the LPH 140 is reduced to reduce vibration of the entire LPH 140.

If the dynamic vibration absorber 50 according to the tenth exemplary embodiment illustrated in FIGS. 14A and 14B is attached to the LPH 140, in contrast, as indicated by the solid line in FIG. 15, the amplitude is reduced at the natural frequency fa of the LPH 140, and an increase in the amplitude at the natural frequency fb of the LPH 140 with the dynamic vibration absorber 50 attached thereto is suppressed.

That is, with the support portion 53 (rubber member 531) provided continuously from one end to the other end of the weight 51 in the Z direction, vibration of the LPH 140 is damped better by the viscosity of the rubber member 531 to reduce vibration of the entire LPH 140 better.

Figure 16A:
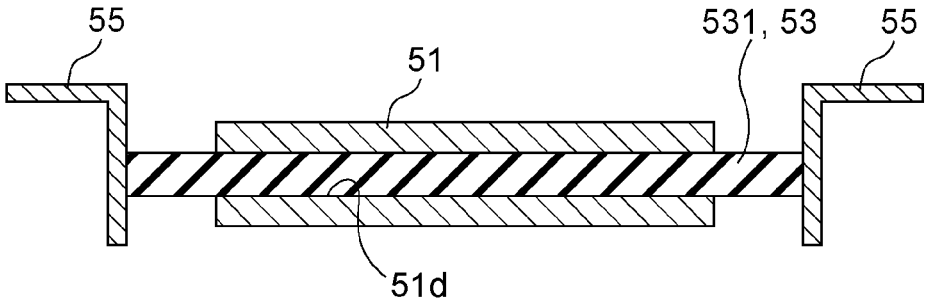
FIGS. 16A and 16B each illustrate a dynamic vibration absorber according to a modification of the tenth exemplary embodiment.
Figure 16B:
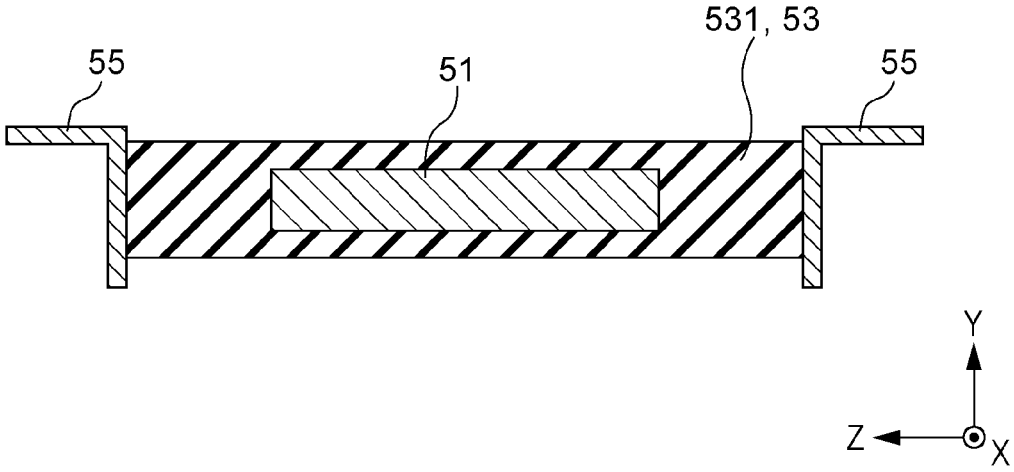

Subsequently, the dynamic vibration absorber 50 according to a modification of the tenth exemplary embodiment will be described. FIGS. 16A and 16B each illustrate the dynamic vibration absorber 50 according to a modification of the tenth exemplary embodiment, and are each a sectional view of the dynamic vibration absorber 50 taken along the YZ plane.

In FIGS. 14A and 14B discussed above, the support portion 53 of the dynamic vibration absorber 50 includes the rubber member 531 and the wire member 533. However, the support portion 53 may not include the wire member 533 as long as the rubber member 531 which is elastic and viscous is provided continuously from one end to the other end of the weight 51 in the Z direction. That is, with the rubber member 531 provided continuously from one end to the other end of the weight 51 in the Z direction, the volume of the rubber member 531 is increased compared to a case where the rubber members 531 are separated from each other in the Z direction by the weight 51, for example. Then, vibration of the LPH 14 is damped better by the viscosity of the rubber member 531.

In the example illustrated in FIG. 16A, as in the example illustrated in FIGS. 14A and 14B, the weight 51 is formed with the opening 51*d* in a circular column shape. Then, the rubber member 531 of the support portion 53 is provided so as to penetrate the opening 51*d*, which is formed in the weight 51, in the Z direction.

In the example illustrated in FIG. 16B, the weight 51 is contained inside the rubber member 531 which is provided continuously in the Z direction between two attachment members 55. In the example illustrated in FIG. 16A, the shape of the rubber member 531 and the weight 51 is not specifically limited. From the viewpoint of suppressing fluctuations in vibration due to deformation of the rubber member 531, however, the shape of the rubber member 531 and the weight 51 is preferably symmetrical with respect to the center axis thereof which extends in the Z direction.

The dynamic vibration absorber 50 illustrated in FIG. 16B is obtained by pouring a material for forming the rubber member 531 into a mold, in which the weight 51 is installed in advance, to be molded, for example.

Eleventh Exemplary Embodiment

Figure 17A:
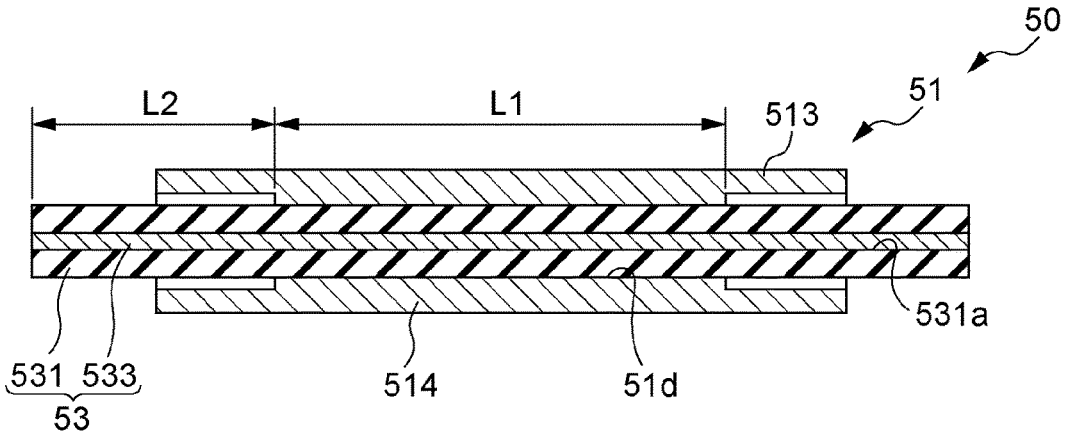
FIGS. 17A and 17B each illustrate the configuration of a dynamic vibration absorber according to an eleventh exemplary embodiment.
Figure 17B:
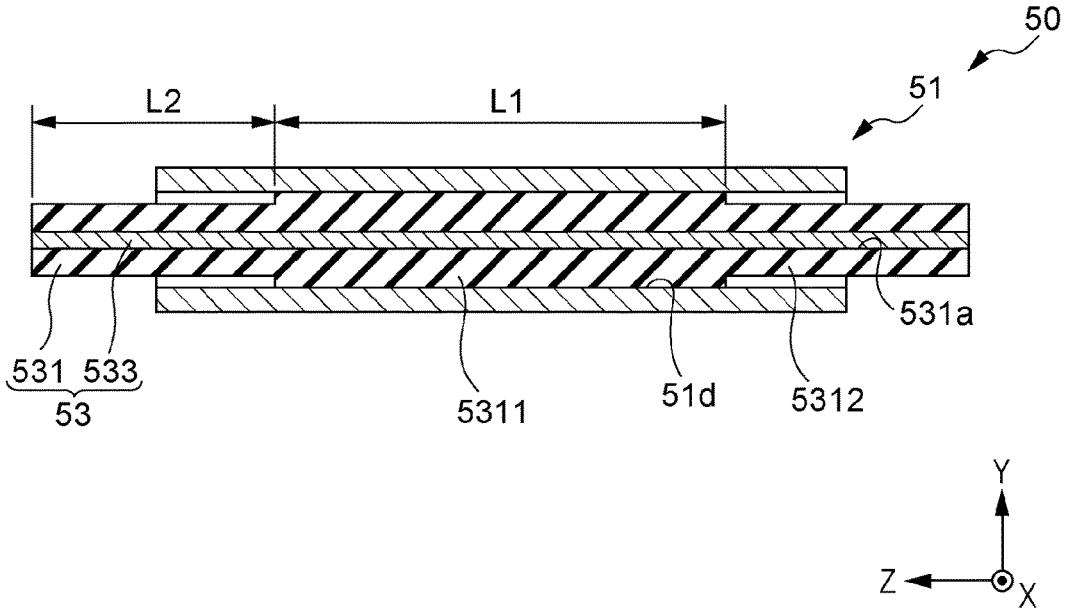

Subsequently, an eleventh exemplary embodiment of the present invention will be described. FIGS. 17A and 17B illustrate the configuration of the dynamic vibration absorber 50 according to the eleventh exemplary embodiment, and are each a sectional view of the weight 51 and the support portion 53 of the dynamic vibration absorber 50 taken along the YZ plane. In FIGS. 17A and 17B, the attachment member 55 (see FIG. 7 etc.) for the dynamic vibration absorber 50 is not illustrated.

In the tenth exemplary embodiment discussed above, the outer peripheral surface of the rubber member 531 contacts the inner wall of the opening 51*d* which is formed in the weight 51 over the entire region in the Z direction. In other words, in the tenth exemplary embodiment, the weight 51 is fixed with respect to the rubber member 531 of the support portion 53 over the entire region in the Z direction.

In the dynamic vibration absorber 50 according to the eleventh exemplary embodiment, in contrast, the weight 51 is fixed with respect to the rubber member 531 of the support portion 53 at the middle portion in the Z direction. Regions in which the weight 51 is not fixed with respect to the rubber member 531 with the inner wall of the opening 51*d* in the weight 51 and the outer peripheral surface of the rubber member 531 not contacting each other are formed at both end portions of the rubber member 531 in the Z direction.

First, the configuration of the dynamic vibration absorber 50 illustrated in FIG. 17A will be described.

In the example illustrated in FIG. 17A, the weight 51 has a cylindrical shape which has an axis in the Z direction and in which the opening 51*d* extending in the Z direction is formed. The diameter of the opening 51*d* in the weight 51 is larger at both end portions in the Z direction than at the middle portion in the Z direction. In other words, the weight 51 has a narrow portion 514 positioned at the middle portion in the Z direction, and wide portions 513 which are positioned at both ends of the narrow portion 514 in the Z direction and in which the diameter of the opening 51*d* is larger than that in the narrow portion 514.

In the example illustrated in FIG. 17A, as in the tenth exemplary embodiment etc., the support portion 53 which serves as an example of an elastic portion includes the rubber member 531 which serves as an example of a first elastic portion that has a circular column shape that has an axis in the Z direction, and the wire member 533 which serves as an example of a second elastic portion that penetrates the rubber member 531 in the Z direction.

The outside diameter of the rubber member 531 is equal over the entire region in the Z direction. The outside diameter of the rubber member 531 is smaller than the diameter of the opening 51*d* in the wide portions 513 of the weight 51, and slightly larger than the diameter of the opening 51*d* in the narrow portion 514 of the weight 51.

With the rubber member 531 inserted into the opening 51*d* of the weight 51, the outer peripheral surface of the rubber member 531 is brought into tight contact with the narrow portion 514, which is positioned at the middle portion of the weight 51 in the Z direction, by the elastic restoring force of the rubber member 531. Consequently, the narrow portion 514 of the weight 51 is fixed with respect to the rubber member 531.

In the wide portions 513 which are positioned at both end portions of the weight 51 in the Z direction, meanwhile, the inner wall of the opening 51*d* and the outer peripheral surface of the rubber member 531 do not contact each other.

Consequently, the rubber member 531 has a fixed region L1 which is positioned at the middle portion in the Z direction and to which the weight 51 is fixed, and non-fixed regions L2 which are positioned at both end portions in the Z direction and to which the weight 51 is not fixed.

Subsequently, the configuration of the dynamic vibration absorber 50 illustrated in FIG. 17B will be described.

In the example illustrated in FIG. 17B, as in the tenth exemplary embodiment etc., the weight 51 is formed in a cylindrical shape. The diameter of the opening 51*d* in the weight 51 is equal from one end to the other end in the Z direction.

In the example illustrated in FIG. 17B, the outside diameter of the rubber member 531 of the support portion 53 at the middle portion in the Z direction is larger than that at both end portions in the Z direction. In other words, the rubber member 531 has a large diameter portion 5311 positioned at the middle portion in the Z direction, and small diameter portions 5312 that are positioned at both ends of the large diameter portion 5311 in the Z direction and that have an outside diameter that is smaller than that in the large diameter portion 5311. In this example, the outside diameter of the large diameter portion 5311 of the rubber member 531 is slightly larger than the diameter of the opening 51*d* in the weight 51. Meanwhile, the outside diameter of the small diameter portions 5312 of the rubber member 531 is smaller than the diameter of the opening 51*d* in the weight 51.

With the rubber member 531 inserted into the opening 51*d* of the weight 51, the large diameter portion 5311 of the rubber member 531 is brought into tight contact with the weight 51 by the elastic restoring force of the rubber member 531. Consequently, the weight 51 is fixed with respect to the large diameter portion 5311 of the rubber member 531.

The small diameter portions 5312 of the rubber member 531 do not contact the weight 51.

Consequently, the rubber member 531 has a fixed region L1 which is positioned at the middle portion in the Z direction and to which the weight 51 is fixed, and non-fixed regions L2 which are positioned at both end portions in the Z direction and to which the weight 51 is not fixed.

In the dynamic vibration absorber 50 in which the rubber member 531 penetrates the opening 51*d* of the weight 51, a region in which the weight 51 is fixed to the rubber member 531 is not easily deformable by vibration of the weight 51, and therefore does not contribute to the vibration suppression properties of the LPH 140 very much.

In the dynamic vibration absorber 50 according to the present exemplary embodiment, the weight 51 is fixed with respect to the middle portion of the rubber member 531 in the Z direction, and the non-fixed regions L2 in which the weight 51 is not fixed are provided at both end portions in the Z direction. Thus, a high ratio of the rubber member 531 contributes to vibration suppression properties compared to a case where the weight 51 is fixed with respect to the rubber member 531 over the entire region in the Z direction, for example. Consequently, the vibration suppression performance of the LPH 140 is enhanced.

The natural frequency f of the dynamic vibration absorber 50 is fluctuated in accordance with the mass of the weight 51 and the length of the non-fixed regions L2 of the rubber member 531 in which the weight 51 is not fixed.

In the dynamic vibration absorber 50 in which the rubber member 531 penetrates the weight 51, it is necessary to provide the weight 51 with the opening 51*d*, and therefore it is necessary to increase the length of the weight 51 in the Z direction in order to obtain the same mass as that of the weight 51 which is solid and not provided with the opening 51*d*. In the present exemplary embodiment, the length of the weight 51 in the Z direction may be increased, while maintaining the length of the non-fixed regions L2 of the rubber member 531 which contributes to the vibration suppression performance of the LPH 140, by increasing the length of the both end portions of the weight 51 which are not fixed to the rubber member 531. In other words, in the dynamic vibration absorber 50 according to the present exemplary embodiment, it is possible to adjust the natural frequency f of the dynamic vibration absorber 50 while suppressing an increase in the size of the dynamic vibration absorber 50, which improves the vibration suppression performance of the dynamic vibration absorber 50 and reduces the size of the dynamic vibration absorber 50.

It is also conceivable to increase the outside diameter of the weight 51 as a method of making the mass of the weight 51 equal to that of the weight 51 which is solid. However, such a method is not preferable because the weight 51 is disposed so as to face the LPH 140 and increasing the outside diameter of the weight 51 tends to cause interference between the weight 51 and the LPH 140 etc.

Figure 18A:
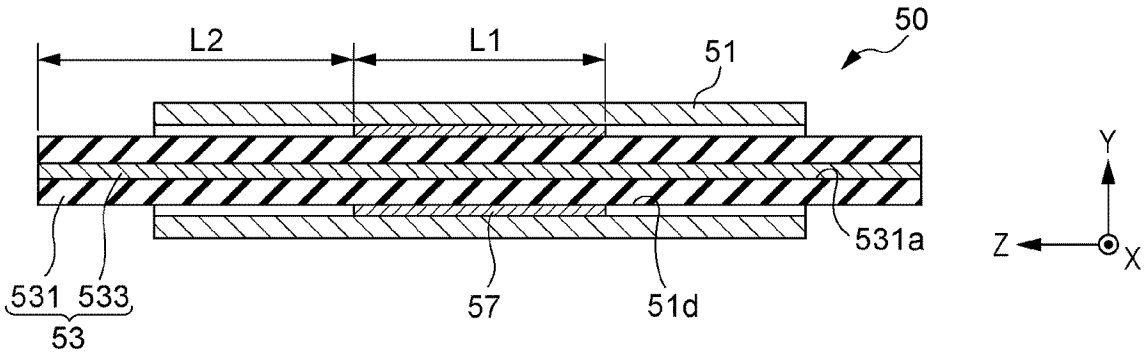
FIGS. 18A and 18B illustrate a dynamic vibration absorber according to a modification of the eleventh exemplary embodiment.
Figure 18B:
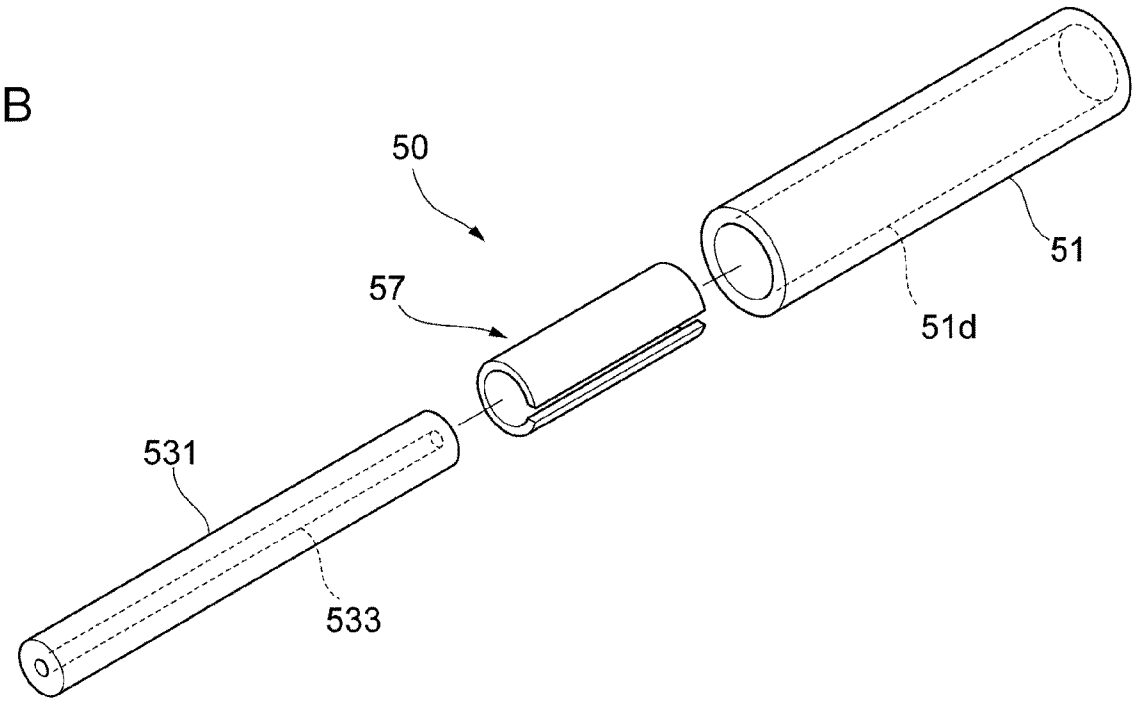

Subsequently, the dynamic vibration absorber 50 according to a modification of the eleventh exemplary embodiment will be described. FIGS. 18A and 18B illustrate the dynamic vibration absorber 50 according to a modification of the eleventh exemplary embodiment. FIG. 18A is a sectional view of the dynamic vibration absorber 50 taken along the YZ plane. FIG. 18B is an exploded perspective view of the dynamic vibration absorber 50. In FIGS. 18A and 18B, the attachment member 55 (see FIG. 7) for the dynamic vibration absorber 50 is not illustrated.

In FIGS. 17A and 17B discussed above, the fixed region L1 in which the weight 51 is fixed and the non-fixed regions L2 in which the weight 51 is not fixed are formed by making the diameter of the opening 51*d* in the weight 51 or the outside diameter of the rubber member 531 different between the middle portion and the both end portions in the Z direction. In the example illustrated in FIGS. 18A and 18B, in contrast, the fixed region L1 in which the weight 51 is fixed and the non-fixed regions L2 in which the weight 51 is not fixed are formed by providing a fixing member 57 that fixes the weight 51 with respect to the rubber member 531 at the middle portion of the dynamic vibration absorber 50 in the Z direction.

Specifically, in the example illustrated in FIGS. 18A and 18B, the weight 51 has a cylindrical shape in which the opening 51*d* extending in the Z direction is formed. The diameter of the opening 51*d* in the weight 51 is equal from one end to the other end in the Z direction.

The support portion 53 includes the rubber member 531 in a circular column shape that has an axis along the Z direction, and the wire member 533 which penetrates the rubber member 531 in the Z direction. The outside diameter of the rubber member 531 is equal from one end to the other end in the Z direction, and smaller than the diameter of the opening 51*d* in the weight 51.

The fixing member 57 has a cylindrical shape in which a cut is formed along the Z direction, and has a C-shaped cross section in a plane that is perpendicular to the Z direction. The length of the fixing member 57 in the Z direction is smaller than the length of the weight 51 in the Z direction.

To assemble the dynamic vibration absorber 50, as illustrated in FIG. 18B, the support portion 53 is inserted into the opening 51*d* of the weight 51 with the fixing member 57 attached to the outer periphery of the rubber member 531. Consequently, the fixing member 57 is interposed between the outer periphery of the rubber member 531 and the inner wall of the opening 51*d* in the weight 51. When the fixing member 57 is inserted into the opening 51*d*, the fixing member 57 is pressed by the inner wall of the opening 51*d* to be deformed such that the cut is closed. Consequently, the fixing member 57 is engaged with the outer peripheral surface of the rubber member 531, and the weight 51 is fixed with respect to the middle portion of the rubber member 531 in the Z direction by the fixing member 57. Meanwhile, the rubber member 531 and the weight 51 do not contact each other at both end portions in the Z direction at which the fixing member 57 is not provided.

In the examples illustrated in FIGS. 17A and 17B and 18A and 18B, the rubber member 531 and the weight 51 do not contact each other in the non-fixed regions L2 in which the weight 51 is not fixed with respect to the rubber member 531. However, the rubber member 531 and the weight 51 may contact each other in at least a part of the non-fixed regions L2 as long as the weight 51 is not fixed with respect to the rubber member 531.

From the viewpoint of promoting deformation of the rubber member 531 that accompanies vibration of the weight 51 and suppressing vibration of the LPH 140 through deformation of the rubber member 531, however, the rubber member 531 and the weight 51 preferably do not contact each other. From the viewpoint of damping vibration of the LPH 140 through friction between the rubber member 531 and the weight 51 as described in relation to a twelfth exemplary embodiment discussed later, on the other hand, the rubber member 531 and the weight 51 preferably contact each other.

Twelfth Exemplary Embodiment

Figure 19:
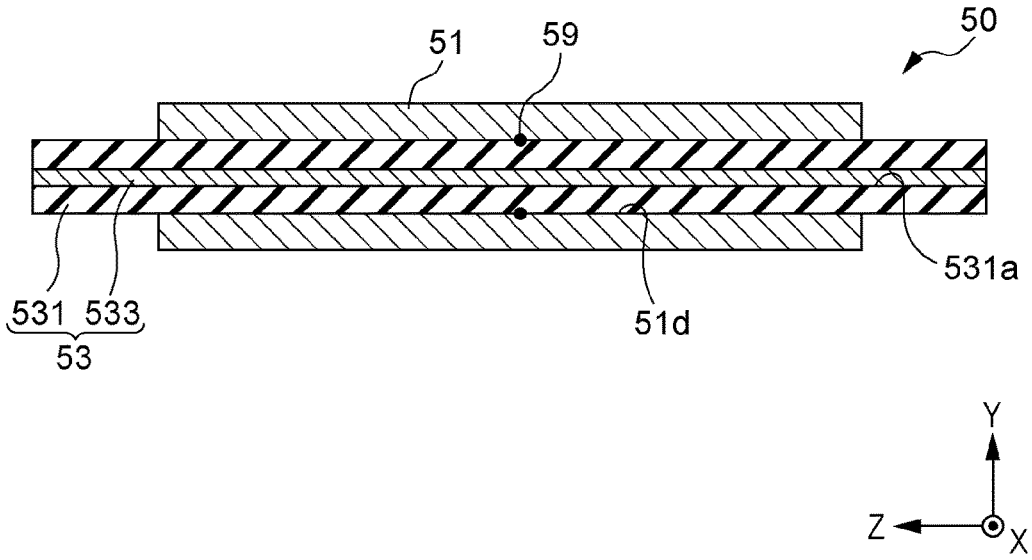
FIG. 19 illustrates the configuration of a dynamic vibration absorber according to a twelfth exemplary embodiment.

Subsequently, a twelfth exemplary embodiment of the present invention will be described. FIG. 19 illustrates the configuration of the dynamic vibration absorber 50 according to the twelfth exemplary embodiment, and is a sectional view of the weight 51 and the support portion 53 of the dynamic vibration absorber 50 taken along the YZ plane. In FIG. 19, the attachment member 55 (see FIG. 7 etc.) for the dynamic vibration absorber 50 is not illustrated.

The dynamic vibration absorber 50 according to the twelfth exemplary embodiment includes the weight 51 and the support portion 53 as in the tenth exemplary embodiment.

The weight 51 has a cylindrical shape which has an axis in the Z direction and in which the opening 51*d* extending in the Z direction is formed. The diameter of the opening 51*d* in the weight 51 is equal from one end to the other end in the Z direction.

As in the tenth exemplary embodiment etc., the support portion 53 includes the rubber member 531 which serves as an example of a first elastic portion that has a circular column shape that has an axis in the Z direction, and the wire member 533 which serves as an example of a second elastic portion that penetrates the rubber member 531 in the Z direction.

The outside diameter of the rubber member 531 is equal over the entire region in the Z direction. The outside diameter of the rubber member 531 is equal to the diameter of the opening 51*d* in the weight 51.

In the dynamic vibration absorber 50 according to the twelfth exemplary embodiment, the weight 51 and the rubber member 531 of the support portion 53 are fixed to each other by an adhesive 59 at the middle portion in the Z direction. In the dynamic vibration absorber 50 according to the twelfth exemplary embodiment, further, the weight 51 and the rubber member 531 are not fixed to each other in regions other than the middle portion in the Z direction at which the weight 51 and the rubber member 531 are fixed to each other by the adhesive 59.

In the dynamic vibration absorber 50 according to the twelfth exemplary embodiment, further, the inner wall of the opening 51*d* which is formed in the weight 51 and the outer peripheral surface of the rubber member 531 contact each other, although the weight 51 and the rubber member 531 are not fixed to each other, in regions other than the middle portion in the Z direction.

In the twelfth exemplary embodiment, the weight 51 and the rubber member 531 are fixed to each other only at the middle portion in the Z direction, and thus a high ratio of the rubber member 531 contributes to vibration suppression properties compared to a case where the weight 51 is fixed with respect to the rubber member 531 over the entire region in the Z direction, for example, as in the eleventh exemplary embodiment discussed above. Consequently, the vibration suppression performance of the LPH 140 is enhanced.

In the dynamic vibration absorber 50 according to the twelfth exemplary embodiment, the inner wall of the opening 51*d* which is formed in the weight 51 and the outer peripheral surface of the rubber member 531 contact each other in regions other than the middle portion in the Z direction, and thus friction occurs between the inner wall of the opening 51*d* which is formed in the weight 51 and the outer peripheral surface of the rubber member 531 in the case where vibration is input to the exposure device 14 and the weight 51 vibrates. As a result, vibration of the LPH 140 is damped by a vibration damping force due to friction between the inner wall of the opening 51*d* which is formed in the weight 51 and the outer peripheral surface of the rubber member 531.

Figure 20:
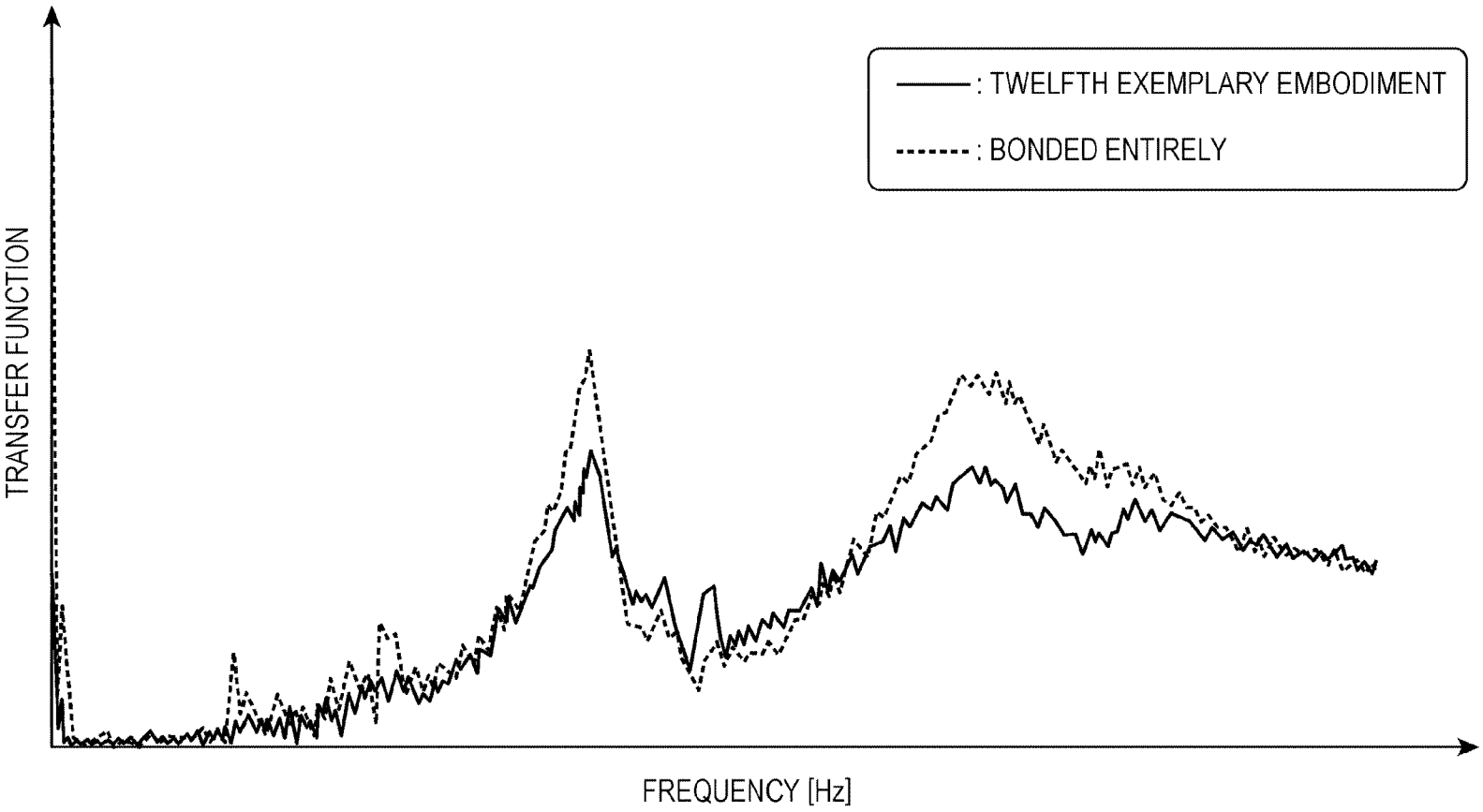
FIG. 20 illustrates the characteristics of vibration of an LPH, illustrating the relationship between the vibration frequency and the transfer function of the LPH.

FIG. 20 illustrates the characteristics of vibration of the LPH 140, illustrating the relationship between the vibration frequency and the transfer function of the LPH 140. In FIG. 20, the solid line indicates a transfer function for a case where the dynamic vibration absorber 50 according to the twelfth exemplary embodiment illustrated in FIG. 19 is attached to the LPH 140. In FIG. 20, meanwhile, the broken line indicates a transfer function for a case where the dynamic vibration absorber 50 in which the rubber member 531 and the weight 51 are bonded to each other by an adhesive over the entire region in the Z direction is attached to the LPH 140.

As illustrated in FIG. 20, vibration of the LPH 140 is damped well with a configuration in which the weight 51 and the rubber member 531 are fixed to each other only at the middle portion in the Z direction and the inner wall of the opening 51*d* which is formed in the weight 51 and the outer peripheral surface of the rubber member 531 contact each other in regions other than the middle portion in the Z direction, compared to a case where the weight 51 is fixed with respect to the rubber member 531 over the entire region in the Z direction.

Subsequently, the dynamic vibration absorber 50 according to a modification of the twelfth exemplary embodiment will be described. FIGS. 21A to 21D each illustrate the dynamic vibration absorber 50 according to a modification of the twelfth exemplary embodiment, and are each a sectional view of the dynamic vibration absorber 50 taken along the YZ plane.

In the dynamic vibration absorber 50 illustrated in FIG. 19 discussed above, the weight 51 and the rubber member 531 are fixed to each other using the adhesive 59 at the middle portion in the Z direction. However, the configuration of the dynamic vibration absorber 50 according to the twelfth exemplary embodiment is not limited to that in the example illustrated in FIG. 19 as long as the inner wall of the opening 51*d* which is formed in the weight 51 and the outer peripheral surface of the rubber member 531 contact each other in at least a part of the region and the weight 51 is not removable from the rubber member 531.

Figure 21A:
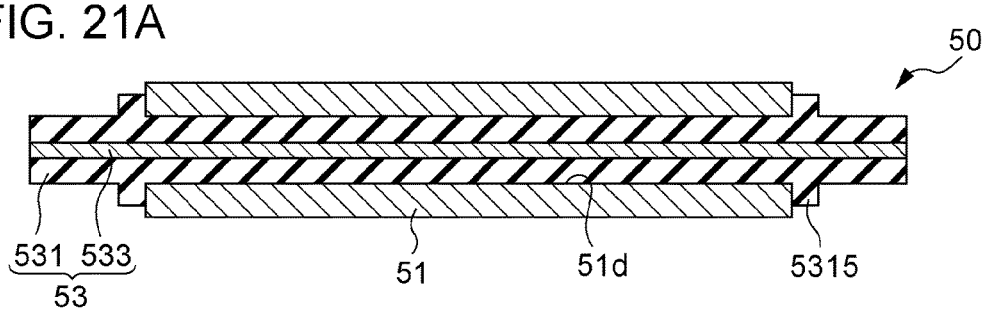
FIGS. 21A to 21D each illustrate a dynamic vibration absorber according to a modification of the twelfth exemplary embodiment.
Figure 21B:
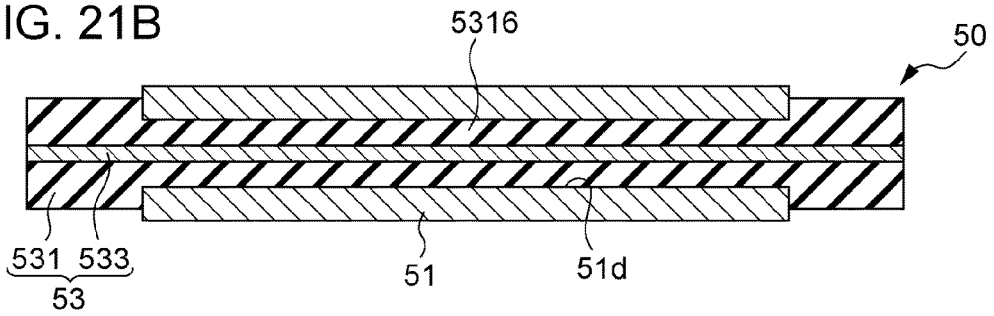

The dynamic vibration absorber 50 may be configured such that the inner wall of the opening 51*d* which is formed in the weight 51 and the outer peripheral surface of the rubber member 531 contact each other in at least a part of the region and the weight 51 is not removable from the rubber member 531 by changing the shape of the rubber member 531 as illustrated in FIGS. 21A and 21B, for example.

Specifically, in the dynamic vibration absorber 50 illustrated in FIG. 21A, the rubber member 531 includes two protruding portions 5315 that serve as an example of a contact portion that projects in the circumferential direction. The spacing between the protruding portions 5315 of the rubber member 531 is equal to the length of the weight 51 in the Z direction. The weight 51 is disposed between the two protruding portions 5315 which are formed on the rubber member 531.

With the dynamic vibration absorber 50 configured as illustrated in FIG. 21A, removal of the weight 51 from the rubber member 531 due to movement of the weight 51 in the Z direction with respect to the rubber member 531 is suppressed with the weight 51 contacting the protruding portions 5315 in the case where the weight 51 vibrates, even in the case where the rubber member 531 and the weight 51 are not bonded to each other using the adhesive 59 (see FIG. 19).

In addition, the surface of the weight 51 and the surface of the rubber member 531 contact each other in a region in which the weight 51 and the rubber member 531 face each other. Consequently, vibration of the LPH 140 is damped better by a vibration damping force due to friction caused in the entire region in which the weight 51 and the rubber member 531 contact each other in the case where the weight 51 vibrates.

In the dynamic vibration absorber 50 illustrated in FIG. 21B, meanwhile, the rubber member 531 includes a recessed portion 5316 at the middle portion in the Z direction that is smaller in the outside diameter than both end portions in the Z direction. The length of the recessed portion 5316 of the rubber member 531 in the Z direction is equal to the length of the weight 51 in the Z direction. The weight 51 is disposed at the outer periphery of the recessed portion 5316 of the rubber member 531.

With the dynamic vibration absorber 50 configured in this way, removal of the weight 51 from the rubber member 531 due to movement of the weight 51 in the Z direction with respect to the rubber member 531 is suppressed, even in the case where the rubber member 531 and the weight 51 are not bonded to each other using the adhesive 59 (see FIG. 19).

The surface of the weight 51 and the surface of the rubber member 531 contact each other in a region in which the weight 51 and the rubber member 531 face each other. Consequently, vibration of the LPH 140 is damped better by a vibration damping force due to friction caused in the entire region in which the weight 51 and the rubber member 531 contact each other in the case where the weight 51 vibrates.

In the example illustrated in FIG. 21B, further, the outside diameter of both end portions of the rubber member 531 in the Z direction is larger than that of the middle portion thereof, and therefore the volume of the rubber member 531 is increased compared to a case where the outside diameter of the rubber member 531 at both end portions in the Z direction is equal to that of the middle portion thereof, for example. Consequently, vibration of the LPH 14 is damped better with a vibration damping force due to the viscosity of the rubber member 531 acting better.

Figure 21C:
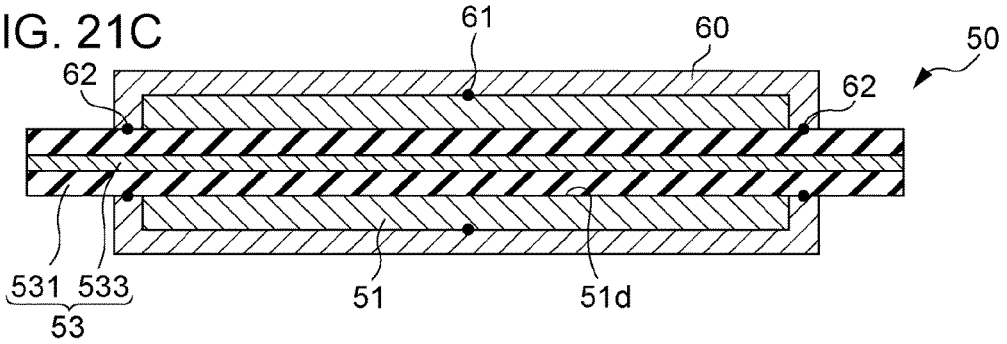
Figure 21D:
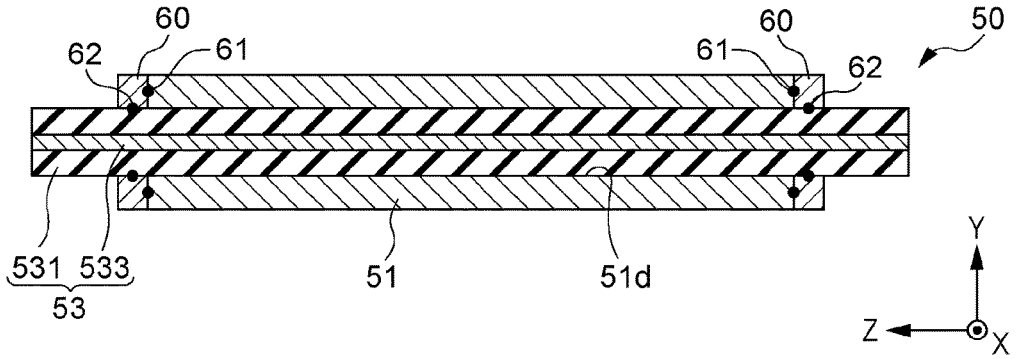

In the dynamic vibration absorber 50, as illustrated in FIGS. 21C and 21D, for example, the weight 51 may be connected to the rubber member 531 using a connection member 60 that is separate from the rubber member 531 and the weight 51, rather than directly bonding the weight 51 to the rubber member 531.

Specifically, in the dynamic vibration absorber 50 illustrated in FIGS. 21C and 21D, the weight 51 and the connection member 60 are bonded to each other by an adhesive 61, and the connection member 60 and the rubber member 531 are bonded to each other by an adhesive 62. Consequently, the weight 51 is connected to the rubber member 531 via the connection member 60.

With the dynamic vibration absorber 50 configured in this way, removal of the weight 51 from the rubber member 531 due to movement of the weight 51 in the Z direction with respect to the rubber member 531 is suppressed, even in the case where the rubber member 531 and the weight 51 are not directly bonded to each other.

An elastic member that is less rigid than the rubber member 531 may be used as the connection member 60. More specifically, the connection member 60 may be formed from a foamable resin such as polyurethane, polyethylene, polyamide, or melamine.

With the connection member 60 formed from an elastic member that is less rigid than the rubber member 531, the connection member 60 is deformed as the weight 51 vibrates. Consequently, vibration of the LPH 140 is damped better by a vibration damping force due to friction caused in the entire region in which the weight 51 and the rubber member 531 contact each other.

The shape of the connection member 60 is not specifically limited as long as the weight 51 may be connected to the rubber member 531. For example, the connection member 60 may be shaped so as to cover the weight 51 from the outer side as illustrated in FIG. 21C. In the example illustrated in FIG. 21C, assembly of the dynamic vibration absorber 50 is facilitated because the direction in which the weight 51 and the connection member 60 are bonded to each other by the adhesive 61 and the direction in which the connection member 60 and the rubber member 531 are bonded to each other by the adhesive 62 are the same as each other.

Alternatively, the connection member 60 may be formed in a circular ring shape to be provided adjacent to the weight 51 in the Z direction as illustrated in FIG. 21D. In the example illustrated in FIG. 21D, the connection member 60 is not provided at the outer periphery of the weight 61, and therefore the outside diameter of the dynamic vibration absorber 50 is reduced to reduce the size of the dynamic vibration absorber 50 compared to the example illustrated in FIG. 21C.

In the dynamic vibration absorber 50 according to the eleventh exemplary embodiment illustrated in FIGS. 17A and 17B and FIGS. 18A and 18B and the dynamic vibration absorber 50 according to the twelfth exemplary embodiment illustrated in FIG. 19 and FIGS. 21A to 21D, the support portion 53 includes the rubber member 531 and the wire member 533. However, the support portion 53 does not necessarily include the wire member 533 as long as the support portion 53 includes the rubber member 531 which is elastic and viscous.

In the examples illustrated in FIGS. 1 to 21A to 21D, the exposure device 14 is disposed vertically below the photosensitive drum 12. The LPH 140 emits light vertically upward from a location vertically below, and the dynamic vibration absorber 50 attached vertically below the LPH 140.

However, the arrangement of the exposure device 14 and the position of the dynamic vibration absorber 50 with respect to the LPH 140 are not limited thereto. FIGS. 22A to 22D illustrate different examples of the arrangement of the exposure device 14 with respect to the photosensitive drum 12 and the position of the dynamic vibration absorber 50 with respect to the LPH 140.

Figure 22A:
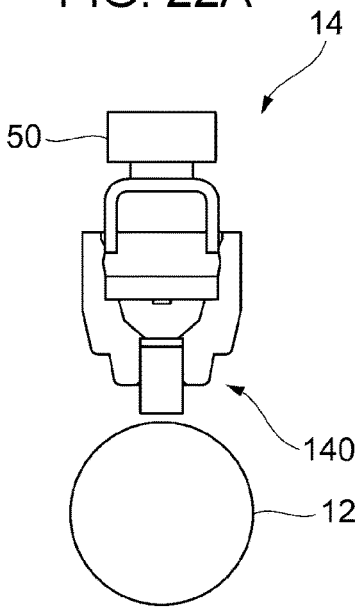
FIGS. 22A to 22D illustrate different examples of the arrangement of an exposure device with respect to a photosensitive drum and the position of a dynamic vibration absorber with respect to an LPH.
Figure 22B:
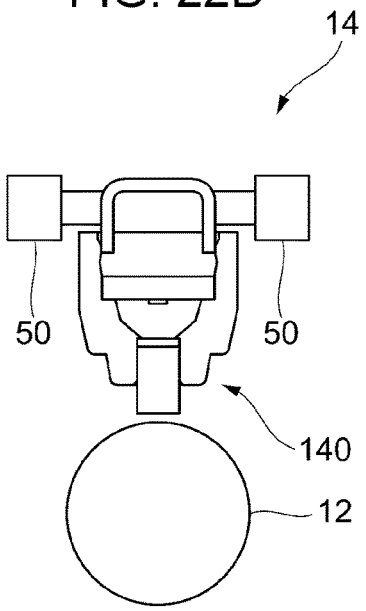

As illustrated in FIGS. 22A and 22B, the exposure device 14 may be disposed vertically above the photosensitive drum 12, and the LPH 140 may emit light vertically downward from a location vertically above. In this case, as illustrated in FIG. 22A, the dynamic vibration absorber 50 may be attached to the opposite side (a location vertically above the LPH 140) in the direction of emission of light by the LPH 140.

Alternatively, as illustrated in FIG. 22B, the dynamic vibration absorber 50 may be attached to a position that is adjacent to the LPH 140 in the sub scanning direction (a side surface of the LPH 140). In this case, from the viewpoint of balance adjustment by suppressing tilt etc. of the exposure device 14, the dynamic vibration absorber 50 is preferably attached to both side surfaces of the LPH 140.

Figure 22C:
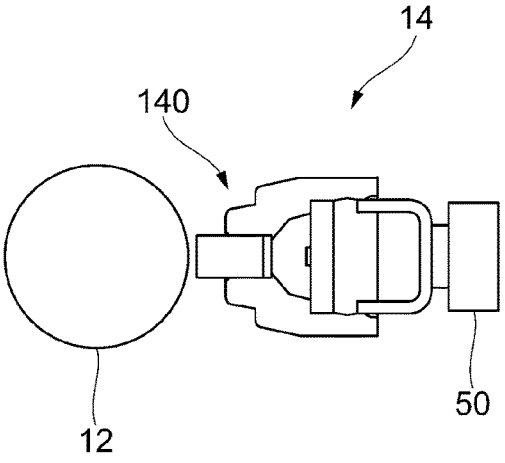
Figure 22D:
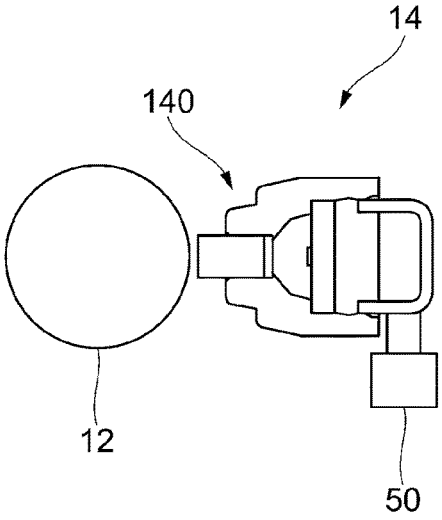

Meanwhile, as illustrated in FIGS. 22C and 22D, the exposure device 14 may be disposed adjacent to the photosensitive drum 12 in the horizontal direction, and the LPH 140 may emit light in the horizontal direction. Also in this case, the dynamic vibration absorber 50 may be attached to the opposite side in the direction of emission of light by the LPH 140 as illustrated in FIG. 22C, or may be attached to a side surface of the LPH 140 as illustrated in FIG. 22D. In the case where the dynamic vibration absorber 50 is attached to the opposite side in the direction of emission of light by the LPH 140 as illustrated in FIG. 22C, a stress that twists the LPH 140 is occasionally generated by movement of the dynamic vibration absorber 50. Thus, the dynamic vibration absorber 50 is preferably attached to a side surface of the LPH 140 as illustrated in FIG. 22D.

In the dynamic vibration absorber 50 according to any of the first to fourth and ninth exemplary embodiments, the weight 51 and the support portion 53 are disposed side by side in a direction (Y direction in the examples discussed above) that intersects the Z direction. Therefore, in the case where the dynamic vibration absorber 50 according to any of the first to fourth and ninth exemplary embodiments is disposed around the photosensitive drum 12, vibration of the weight 51 or deformation of the support portion 53 may be affected by gravity depending on the arrangement. For example, in the first to fourth and ninth exemplary embodiments, the weight 51 may be drooped with the support portion 53 deformed by gravity that acts on the weight 51 in the case where the dynamic vibration absorber 50 is disposed such that the weight 51 and the support portion 53 are arranged side by side in the horizontal direction.

Thus, in the case where the dynamic vibration absorber 50 according to any of the first to fourth and ninth exemplary embodiments is adopted, it is preferable to select the arrangement of the exposure device 14 with respect to the photosensitive drum 12 and the arrangement of the dynamic vibration absorber 50 with respect to the LPH 140 such that the weight 51 and the support portion 53 are disposed side by side in the vertical direction. It is preferable to select the arrangement illustrated in FIG. 22A or 22D, among those illustrated in FIGS. 22A to 22D.

In contrast, in the dynamic vibration absorber 50 according to any of the fifth to eighth and tenth to twelfth exemplary embodiments, for example, the weight 51 and the support portion 53 are disposed along the axial direction (Z direction) of the photosensitive drum 12. Thus, in the case where the dynamic vibration absorber 50 according to any of the fifth to eighth and tenth to twelfth exemplary embodiments is disposed around the photosensitive drum 12, vibration of the weight 51 and deformation of the support portion 53 is not easily affected by gravity. Thus, in the case where the dynamic vibration absorber 50 according to any of the fifth to eighth and tenth to twelfth exemplary embodiments is adopted, there are few restrictions on the arrangement of the exposure device 14 with respect to the photosensitive drum 12 or the arrangement of the dynamic vibration absorber 50 with respect to the LPH 140, and any of the arrangements illustrated in FIGS. 22A to 22D may be selected.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure device comprising:

an exposure section that includes a plurality of light emitting elements arranged along an axial direction of an image holding member that is rotatable, that is positioned with respect to the image holding member at both ends in the axial direction, and that exposes the image holding member to light by emitting light to the image holding member;

a weight disposed so as to face the exposure section and having a mass determined in advance; and an elastic portion that is elastic and that is disposed between the exposure section and the weight to support the weight so as to be vibratable, wherein the elastic portion is disposed at each of one end and the other end of the weight in the axial direction, and attached to the exposure section via an attachment member.

2. The exposure device according to claim 1, wherein the elastic portion is also viscous.

3. The exposure device according to claim 1, wherein the elastic portion and the weight are disposed side by side in an opposite direction to a direction of emission of light by the exposure section with respect to the exposure section.

4. The exposure device according to claim 1, wherein a cross section of the elastic portion taken along a plane that is perpendicular to the axial direction is shaped so as to be line-symmetrical with respect to a direction of emission of light by the exposure section and an axis that extends in a sub scanning direction that is perpendicular to the axial direction and the direction of emission.

5. The exposure device according to claim 1, wherein a natural frequency determined in accordance with a spring constant of the elastic portion and a mass of the weight is generally equal to a natural frequency of the exposure section.

6. The exposure device according to claim 1, wherein the elastic portion includes a first elastic portion that is viscous and elastic and a second elastic portion that is elastic, the first elastic portion has a coefficient of loss tan δ that is more than 0.05 in a use temperature range of the device, and the second elastic portion has a coefficient of loss tan δ that is equal to or less than 0.05 in the use temperature range of the device.

7. The exposure device according to claim 1, wherein the elastic portion is continuous from the one end to the other end of the weight in the axial direction.

8. The exposure device according to claim 7, wherein the weight has an opening that extends in the axial direction, and the elastic portion penetrates the opening of the weight in the axial direction.

9. The exposure device according to claim 8, wherein the weight is fixed with respect to the elastic portion which penetrates the opening, at a part of the weight in the axial direction.

10. The exposure device according to claim 9, wherein the weight is fixed with respect to the elastic portion by increasing an outside diameter of the elastic portion, and/or reducing an inside diameter of the opening, in a part of a region in the axial direction compared to other regions.

11. The exposure device according to claim 8, wherein the weight includes a region that contacts the elastic portion and that is not fixed to the elastic portion.

12. The exposure device according to claim 8, wherein the weight is not fixed with respect to the elastic portion, and the elastic portion includes a contact portion that contacts the weight in the axial direction to hinder movement of the weight along the axial direction.

13. An exposure device comprising:

an exposure section that includes a plurality of light emitting elements arranged along an axial direction of an image holding member that is rotatable, that is positioned with respect to the image holding member at both ends in the axial direction, and that exposes the image holding member to light by emitting light to the image holding member;

a weight disposed so as to face the exposure section and having a mass determined in advance; and an elastic portion that is elastic and that is disposed between the exposure section and the weight to support the weight so as to be vibratable, wherein the elastic portion includes a first elastic portion that is viscous and elastic and a second elastic portion that is elastic with a different temperature dependence from that of the first elastic portion.

14. The exposure device according to claim 13, wherein the first elastic portion and the second elastic portion are provided as superposed on each other at least partially in the axial direction.

15. The exposure device according to claim 14, wherein one of the first elastic portion and the second elastic portion is disposed along the axial direction, and the other of the first elastic portion and the second elastic portion is disposed so as to surround at least a part of the one of the first elastic portion and the second elastic portion.

16. The exposure device according to claim 13, wherein the first elastic portion and/or the second elastic portion are/is shaped so as to be symmetrical with respect to a center axis that extends in the axial direction.

17. The exposure device according to claim 13, wherein the first elastic portion, the second elastic portion, and the weight are shaped so as to be symmetrical with respect to a common center axis that extends in the axial direction.

18. The exposure device according to claim 13, wherein at least one of the first elastic portion and the second elastic portion is attached to the weight through fitting.

19. An exposure device comprising:

an exposure section that includes a plurality of light emitting elements arranged along an axial direction of an image holding member that is rotatable, that is positioned with respect to the image holding member at both ends in the axial direction, and that exposes the image holding member to light by emitting light to the image holding member;

a weight disposed so as to face the exposure section and having a mass determined in advance; and an elastic portion that is elastic and that is disposed between the exposure section and the weight to support the weight so as to be vibratable, wherein the elastic portion includes a first elastic portion that is viscous and elastic and a second elastic portion that is elastic, the second elastic portion being less viscous than the first elastic portion.

* * * * *